US010588404B2

(12) United States Patent
Ng

(10) Patent No.: US 10,588,404 B2
(45) Date of Patent: Mar. 17, 2020

(54) MULTI-TIER INTERLINKED FOLDING FRAME

(71) Applicant: Kelvin Ng, Trabuco Canyon, CA (US)

(72) Inventor: Kelvin Ng, Trabuco Canyon, CA (US)

( * ) Notice: Subject to any disclaimer, the term of this patent is extended or adjusted under 35 U.S.C. 154(b) by 0 days.

(21) Appl. No.: 15/795,090

(22) Filed: Oct. 26, 2017

(65) Prior Publication Data

US 2018/0220792 A1 Aug. 9, 2018

Related U.S. Application Data

(60) Provisional application No. 62/456,469, filed on Feb. 8, 2017.

(51) Int. Cl.

| | |
|---|---|
| ***A47B 43/00*** | (2006.01) |
| ***A47F 5/10*** | (2006.01) |
| *A47B 43/02* | (2006.01) |
| *A47B 43/04* | (2006.01) |

(52) U.S. Cl.

CPC ..... *A47B 43/00* (2013.01); *A47F 5/10* (2013.01); *A47B 43/02* (2013.01); *A47B 43/04* (2013.01)

(58) Field of Classification Search

CPC ..... A47B 43/00; A47B 43/02; A47B 31/04; A47F 5/10; A47F 5/116

See application file for complete search history.

(56) References Cited

U.S. PATENT DOCUMENTS

| | | | | |
|---|---|---|---|---|
| 1,625,294 A * | 4/1927 | Whitesides | A47B 3/083 | 108/175 |
| 2,150,743 A * | 3/1939 | Mancuso | G09F 5/00 | 211/135 |
| 2,277,807 A * | 3/1942 | Whitestone | A47F 5/116 | 108/99 |
| 2,290,144 A * | 7/1942 | Katz | A47F 5/114 | 108/165 |
| 2,726,129 A * | 12/1955 | Knapp, Jr. | A47B 43/02 | 312/258 |
| 2,938,632 A * | 5/1960 | Mondineu | A47B 31/04 | 108/106 |
| 3,093,247 A * | 6/1963 | Erickson | A47B 43/00 | 108/188 |
| 3,827,376 A | 8/1974 | Solomon | | |

(Continued)

FOREIGN PATENT DOCUMENTS

KR 101613689 B1 4/2016

OTHER PUBLICATIONS

Shane Thomas, Notification of Transmittal of the International Search Report and the Written Opinion of the International Searching Authority, or the Declaration, dated Apr. 19, 2018, pp. 1-12.

*Primary Examiner* — Kimberley S Wright

(74) *Attorney, Agent, or Firm* — Klein, O'Neill & Singh, LLP

(57) ABSTRACT

Foldable storage compartment having front and rear panels that are traversable closer to or further away from each other is disclosed. Left and right side collapsible panels may be attached to the front and rear panels. The shelves of the foldable storage compartment may be interlinked with each other by way of a vertical linkage rod and connected to the front panel with a front panel linkage so that traversal of the front and rear panels closer to or further away from each other will also collapse and erect the shelves simultaneously.

15 Claims, 42 Drawing Sheets

(56) References Cited

U.S. PATENT DOCUMENTS

| | | | | |
|---|---|---|---|---|
| 3,841,237 | A | 10/1974 | Plymate | |
| 5,299,704 | A * | 4/1994 | Thorby | B65D 7/26 220/6 |
| 5,664,854 | A * | 9/1997 | Letch | A47B 43/00 312/114 |
| 5,882,098 | A * | 3/1999 | Brown | A47B 3/08 108/179 |
| 6,039,419 | A * | 3/2000 | Brown | A47B 3/08 16/387 |
| 6,123,207 | A | 9/2000 | Mast | |
| 6,213,494 | B1 * | 4/2001 | Liaw | A47B 31/04 280/47.35 |
| 6,443,481 | B1 * | 9/2002 | Stravitz | A47B 31/04 211/201 |
| 6,685,199 | B2 * | 2/2004 | Stravitz | A47B 31/04 211/201 |
| 6,848,371 | B2 * | 2/2005 | Zheng | A47B 43/02 108/165 |
| 6,851,564 | B2 | 2/2005 | Ng | |
| 7,367,220 | B2 | 5/2008 | Thomas | |
| 7,389,887 | B2 * | 6/2008 | Liang | A47B 43/00 211/149 |
| 7,637,220 | B2 * | 12/2009 | Fu | A47B 43/00 108/115 |
| RE41,763 | E | 9/2010 | Ng | |
| 8,256,629 | B2 * | 9/2012 | Zhu | A47B 31/04 211/149 |
| 8,256,630 | B2 | 9/2012 | Zhu et al. | |
| 8,468,956 | B2 * | 6/2013 | Parizek | A47B 3/12 108/157.16 |
| 9,474,368 | B2 * | 10/2016 | Frankel | A47B 43/00 |
| 9,844,282 | B2 * | 12/2017 | Smith | A47F 5/116 |
| 10,058,171 | B2 * | 8/2018 | Deng | A47B 43/00 |
| 10,292,491 | B1 * | 5/2019 | Ke | A47B 43/00 |
| 2004/0089208 | A1 * | 5/2004 | Zheng | A47B 43/02 108/165 |
| 2004/0226491 | A1 | 11/2004 | Chen | |
| 2004/0238469 | A1 | 12/2004 | Ng | |
| 2006/0226101 | A1 * | 10/2006 | Liang | A47B 43/00 211/149 |
| 2010/0006529 | A1 * | 1/2010 | Groff | A47F 5/116 211/186 |
| 2010/0236457 | A1 * | 9/2010 | Parizek | A47B 3/12 108/64 |
| 2011/0068072 | A1 * | 3/2011 | Zhu | A47B 31/04 211/149 |
| 2013/0221818 | A1 * | 8/2013 | Ceballos Godefroy | A47B 43/00 312/258 |
| 2014/0027396 | A1 | 1/2014 | Pratiko | |
| 2015/0366338 | A1 | 12/2015 | Conod | |
| 2016/0066687 | A1 * | 3/2016 | Frankel | A47B 43/00 211/149 |
| 2018/0070747 | A1 * | 3/2018 | Smith | A47F 5/116 |

* cited by examiner

MULTI-TIER INTERLINKED FOLDING FRAME

CROSS-REFERENCE TO RELATED APPLICATIONS

This application relates to and claims the benefit of U.S. Provisional Application No. 62/456,469 filed Feb. 8, 2017, the contents of which is expressly incorporated herein by reference.

STATEMENT RE: FEDERALLY SPONSORED RESEARCH/DEVELOPMENT

Not Applicable

BACKGROUND

The various embodiments and aspects described herein relate to a folder storage compartment.

Storage compartments that are collapsible are typically difficult and time-consuming to erect and collapsed. Oftentimes, they may require equipment such as screwdrivers and hammers to collapse or erect the storage compartments. Unfortunately, because these storage compartments are difficult to erect and collapse, time-consuming to do so and may require equipment for traversing the storage compartments between the collapsed and erected positions, many users cannot or are hesitant to purchase and enjoy the storage compartments.

Accordingly, there is a need in the art for improved storage compartment.

BRIEF SUMMARY

A storage compartment that is foldable is disclosed herein. The foldable storage compartment may have front and rear panels (e.g., frame or solid wall) that are traversable closer to or further away from each other. Left and right collapsible side panels may also be attached to the front and rear panels. The left and right collapsible side panels provide rigidity to the foldable storage compartment. The shelves of the foldable storage compartment may be interlinked to each other with a vertical linkage rod so that traversing one of the shelves to either the collapsed or erected position simultaneously traverses the other shelves to the collapsed or erected position. Moreover, at least one of the shelves may be connected to the front panel with a front panel linkage so that when the front and rear panels are traversed closer to or further away from each other, the front panel linkage moves the shelf to the collapsed or erected position and the vertical linkage rod traverses the other shelves. The shelves are pivotably rotatable about an axis generally aligned (e.g., in the same plane) with the rear panel. In this manner, the foldable storage compartment disclosed herein is easy to erect and collapse and does not necessarily require screwdrivers and hammers to collapse or erect. It is also contemplated that the foldable storage compartment disclosed herein may require a screwdriver or hammer to collapse or erect.

More particularly, a foldable storage compartment for storing objects on a shelf when the storage compartment is in the erect position is disclosed. The foldable storage compartment may comprise a front panel and a rear panel, a first shelf, a collapsible first sidewall and a collapsible second sidewall. The first shelf may define a first side edge and an opposed second side edge to the first side edge and a third front edge and an opposed fourth rear edge to the third front edge. The first shelf may define a horizontal axis by a direction from the first side edge to the opposed second side edge. The first shelf may be foldable about the horizontal axis. The first shelf may be rigid in a direction from the first side edge to the opposed second side edge. The first shelf may be pivotable about the fourth rear edge. The fourth rear edge may be aligned to the rear panel.

The collapsible first sidewall may be disposed adjacent to the first side edge. The collapsible first sidewall may be attached to the front panel and the rear panel. The collapsible first sidewall may be rigid vertically and be collapsible about a first vertical axis.

The collapsible second sidewall may be disposed adjacent to the second side edge. The collapsible second sidewall may be attached to the front panel and the rear panel. The collapsible second sidewall may be rigid vertically and be collapsible about a second vertical axis.

In the foldable storage compartment, the horizontal axis about which the first shelf is foldable may be aligned to a midpoint between the third front edge and the opposed fourth rear edge. Also, the third and fourth edges of the first shelf may be pivotally attached to front and rear sides of the collapsible first and second sidewalls.

Alternatively, the horizontal axis about which the first shelf is foldable may be aligned to the fourth rear edge of the first shelf. Also, the foldable storage compartment may further comprise a linkage pivotally attached to the midpoint of the first shelf between the third front edge and the opposed fourth rear edge and the front side of either one or both of the collapsible first and second sidewalls.

The foldable storage compartment may further comprise a second shelf and a vertical linkage. The second shelf may be disposed below or above the first shelf. The second shelf may be disposed between the first and second sidewalls. The second shelf may define a first side edge and an opposed second side edge to the first side edge and a third front edge and an opposed fourth rear edge to the third front edge. The second shelf may be rigid in a direction from the first side edge to the opposed second side edge. The second shelf may be pivotable about the fourth rear edge of the second shelf. The fourth rear edge of the second shelf may be aligned to the rear panel.

The vertical linkage may be pivotally attached to the first and second shelves at the midpoints of the first and second shelves between the third front edges and the opposed fourth rear edges of the first and second shelves.

At least one of the front panel and the rear panel may be defined by a plurality of elongate members. The elongate members may be a wire rod or a square tubing fabricated from metal, plastic or rigid material.

The first sidewall and the front and rear panels may share a common elongate edge or member so that the first sidewall pivots with respect to the front and rear panels about the common elongate edge or member. Also, the second sidewall and the front and rear panels may share a common elongate edge or member so that the second sidewall pivots with respect to the front and rear panels about the common elongate edge or member.

At least one of the front panel and rear panel may have an opening to access objects placed on the first shelf.

The foldable storage compartment may further comprise a top cover pivotable about the rear panel. The top cover may be pivotable to the rear panel. The top cover may be disposed adjacent to a rear side of the rear panel when the foldable storage compartment is in a collapsed position.

The foldable storage compartment may further comprise a top cover pivotable about the rear panel. The top cover may be pivotable to the rear panel. The top cover may be disposed adjacent to a front side of the rear panel when the foldable storage compartment is in a collapsed position.

In another aspect, a method for collapsing and erecting a foldable storage compartment is disclosed. The method may comprise the steps of providing a foldable storage compartment as discussed herein; and pulling the front and rear panels further away from each other when the foldable storage compartment is in an collapsed position to traverse the foldable storage compartment to an erect position.

The method may further comprise the step of pushing the front and rear panels closer to each other when the foldable storage compartment is in the erect position to traverse the foldable storage compartment to the collapsed position.

The method may further comprise the step of lifting a lid to traverse the front and rear panels closer to each other and traverse the foldable storage compartment to the collapsed position from the erect position.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 20:
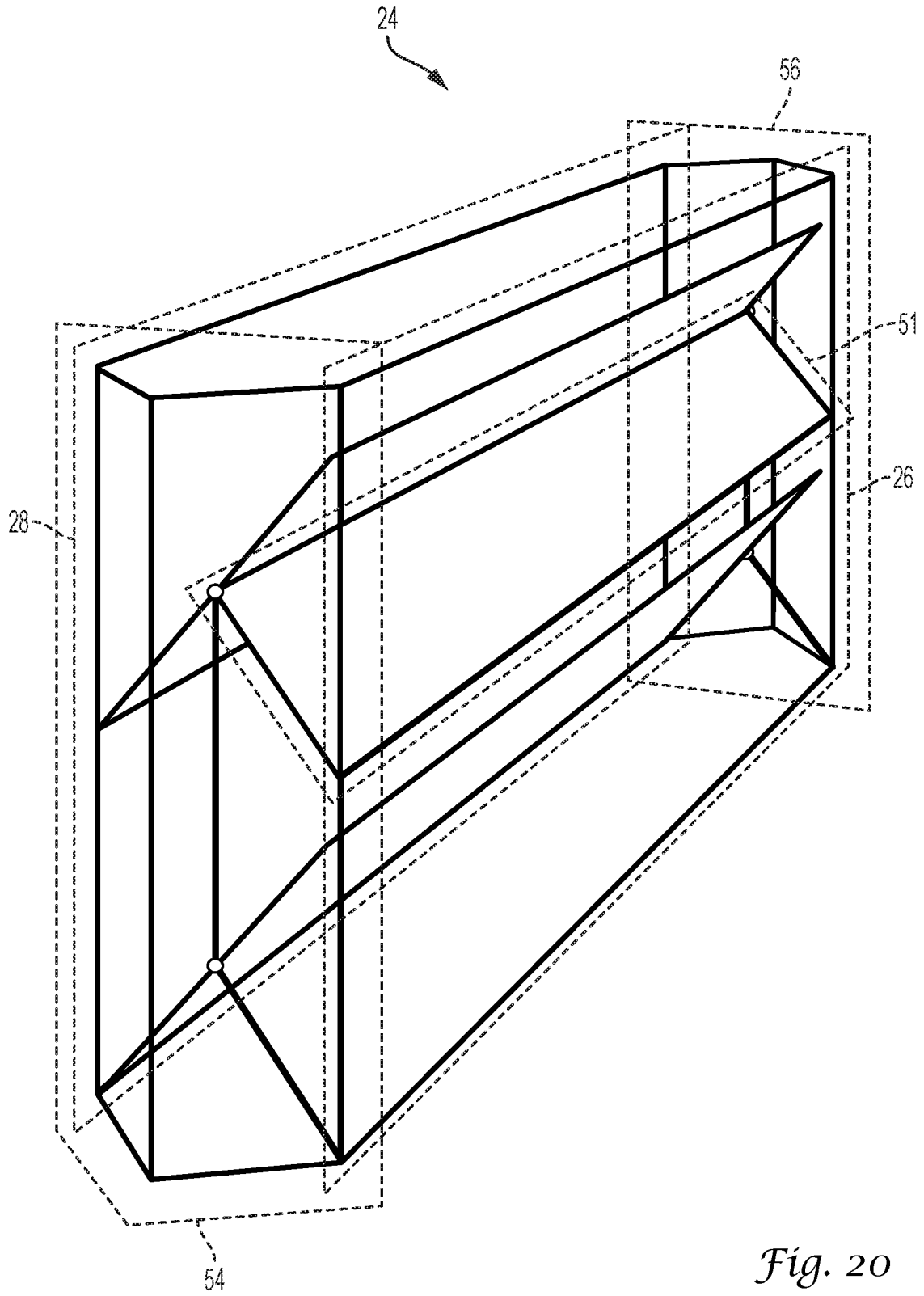
FIG. 20 illustrates a foldable storage compartment without a lid.

Referring now to the drawings, a foldable storage compartment 10, 12, 16, 18, 20, 22, 24 (see FIGS. 1, 8, 11, 15, 17, 18, 20) is shown. The foldable storage compartment 10, 12, 16, 18, 20, 22, 24 can be erected by traversing front and rear panels 26, 28 further apart from each other to the erected position as shown in FIGS. 1A, 8A, 11A, 15A, 17A, 18A. The foldable storage compartment 10, 12, 16, 18, 20, 22, 24 can be collapsed by traversing front and rear panels 26, 28 closer together and/or by pulling up (preferably at a middle portion) on an upper lid 30, 32 to a collapsed position as shown in FIG. 1C, 8C. The upper lid 30, 32 may also be traversed between the collapsed or erected positions by traversing the front and rear panels 26, 28 closer together or further apart from each other, as shown in FIGS. 1A, 1C, 8A, 8C. Alternatively, the upper lids 29, 34 may require an extra step or motion to traverse the upper lids 29, 34 between the collapsed or erected positions as shown in relation to FIGS. 11A-11C, 15A-15C, 17A-17C, 18A-18D. The lids 29, 34 may require an extra motion to close or open because the lids 29, 34 are not connected to shelves with a linkage. The foldable storage compartment 24 does not require the lid as shown in FIG. 20.

The foldable storage compartment 10, 12, 14, 16, 18, 20, 22, 24 allows for a minimal number of motions by the user to collapse or erect the foldable storage compartment. Preferably, the foldable storage compartment requires one or two motions to collapse or erect the foldable storage compartment. Two motions if the upper lid 29, 34 is not interconnected to the shelves with a linkage so that the lid 29, 34 does not move in coordination or conjunction with the shelves as shown in relation to lids 30, 32. Although the preferred embodiments contemplate one or two motions to collapse or erect the foldable storage compartment, it is also contemplated that the interconnections between the shelves, lid, and other parts of the foldable storage compartment may be disconnected to require three or more motions to erect or collapse the foldable storage compartment.

Figure 1:
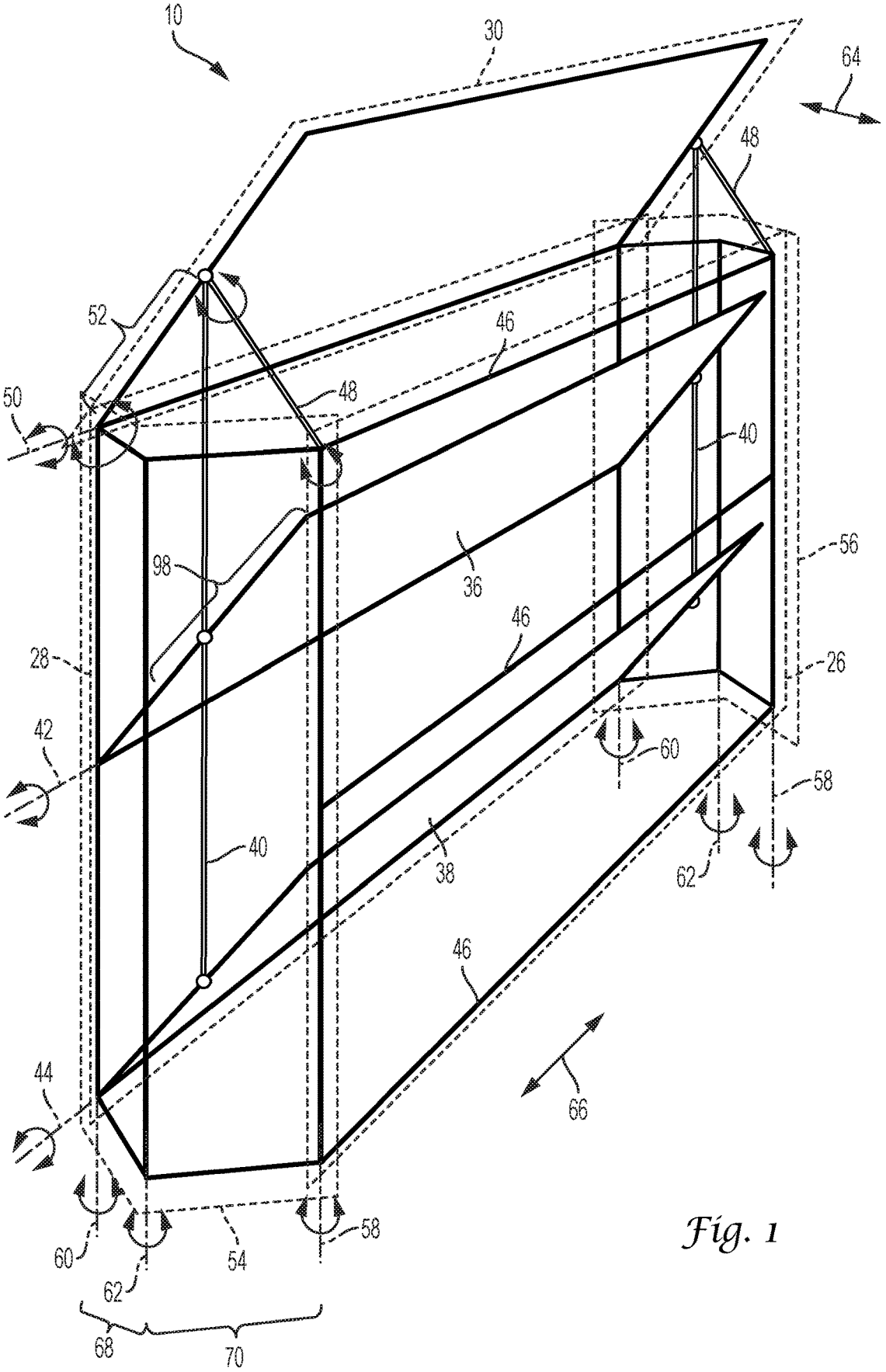
FIG. 1 is a perspective view of a first embodiment of a foldable storage compartment.
Figure 1A:
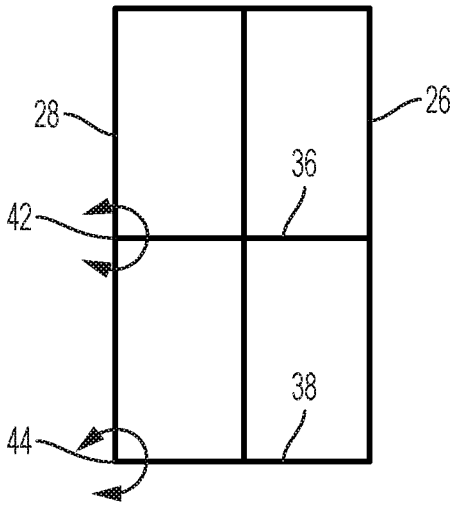
FIG. 1A is a side view of the foldable storage compartment shown in FIG. 1 in a erected position.
Figure 1B:
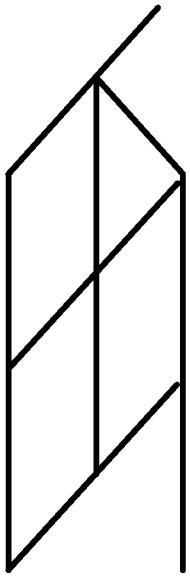
FIG. 1B is a side view of the foldable storage compartment shown in FIG. 1 being collapsed.
Figure 1C:
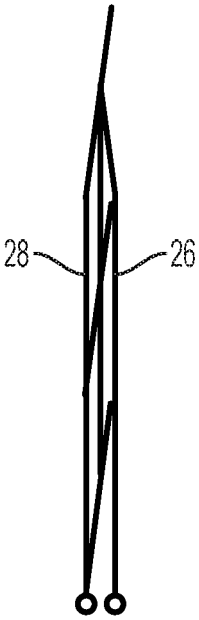
FIG. 1C is a side view of the foldable storage compartment shown in FIG. 1 in a collapsed position.

Referring now to FIG. 1, the foldable storage compartment 10 is shown. The foldable storage compartment 10 includes the front panel 26 and the rear panel 28. Additionally, there may be a first shelf 36 and a second shelf 38. Although the foldable storage compartment 10-24 is described in relation to having first and second shelves 36, 38, it is also contemplated that the foldable storage compartment 10-24 may have one or more shelves. By way of example and not limitation, the foldable storage compartment 10-24 may have a bottom shelf and the lid or it may have two or more shelves. For purposes of illustration and clarity, the foldable storage compartment 10-24 is shown and discussed in relation to having two shelves. The first and second shelves 36, 38 may be linked to each other with a vertical linkage 40. In this manner, when the first or second shelves 36, 38 are pivoted about its rotational axis 42, 44, the other one of the first and second shelves 36, 38 are also pivoted in the same direction and to the same degree. The first and second shelves 36, 38 may be a wooden board, cardboard panel, rigid wire mesh, a wire rod frame with a flexible covering (e.g., cloth) or other generally flat structure or material sufficient to support an object on the first and second shelves 36, 38 when the first and second shelves are in the erected position as shown in FIG. 1A. The first and second shelves 36, 38 may be pivotable about rotational axes 42, 44 which may be coplanar with the rear panel 28 or close by the rear panel 28. The rotational axes 42, 44 may be parallel with each other. By way of example and not limitation, in terms of the closeness of the rear panel 28 and the shelves 36, 38, the rotational axes 42, 44 may be within one to five inches away from the plane of the rear panel 28. Preferably, the rotational axes 42, 44 may be disposed about less than one inch from the plane of the rear panel 28. The first and second shelves 36, 38 may be pivotable with respect to the rear panel 28 with a piano hinge or ball and socket configuration between the respective first and second shelves 36, 38 and the rear panel 28. The first and second shelves 36, 38 may be horizontal to the ground when the first and second shelves 36, 38 are in the erected position as shown in FIG. 1A. The front panel 26 may have a support such as a bar 46 upon which the first and second shelves 36, 38 may rest upon when the first and second shelves 36, 38 are traversed to the erected position. Additionally or alternatively, the shelves 36, 38 may engage hooks or other engagement mechanisms on the bar 46, on the front panel 26 and/or the first and second sidewalls 54, 56 so that the first and second shelves 36, 38 rest upon the hooks or other engagement mechanism.

The vertical linkage 40 may also be attached to the first and second shelves 36, 38. Preferably, the vertical linkage 40 may be attached to both opposed sides of the first and second shelves 36, 38, and more preferably, may be attached to opposed sides at a midpoint defined by distance between the front and rear panels 26, 28. In the figures, the vertical linkage 40 shown as being attached to the midpoint of the shelves 36, 38 and the lid 30, 32. However, the vertical linkage 40 may be attached to the shelves 36, 38 and the lid 30, 32 at other points. By way of example and not limitation, the vertical linkage 40 may be attached to a distal 95% of the shelves 36, 38 and lid 30, 32. By distal 95%, this means by way of example and not limitation, that if the shelves 36, 38 and lid 30, 32 had a depth of ten inches, the vertical linkage 40 may be attached to the shelves 36, 38 and the lid 30, 32½ inch to ten inches away from the rotational axes 42, 44. More preferably, the vertical linkage 40 may be attached to a distal 70% or distal 50% or less of the shelves 36, 38 and lid 30, 32 and may be attached to the distal end portion of the shelves 36, 28 and lid 30, 32 to hid the vertical linkage 40 or aesthetically blend the same with the front panel to make the vertical linkage less noticeable. The distal 70% is identified by reference 98. Moreover, the first and second vertical linkages 40 may also extend upward to be pivotally attached to the top shelf 30 at its midpoint (i.e., defined by a middle location between the front and rear panels 26, 28). When any one of the top shelf or upper lid 30, first shelf 36, second shelf 38 is traversed to the erected or collapsed positions, the other ones of the top shelf or upper lid 30, first shelf 36 and the second shelf 38 are also traversed to the erected or collapsed positions. In the embodiment shown in FIG. 1, the upper lid 30 has a connecting front panel linkage 48. The front panel linkage 48 may be secured or pivotally attached to the front panel 26 at a corresponding vertical height of a rotational axis 50 of the upper lid 30. Additionally, the front panel linkage 48 may be pivotally attached to a midpoint of the upper lid 30 as defined by the distance between the front and rear panels 26, 28. When the front and rear panels 26, 28 are traversed closer to each other or further away from each other, the front panel linkage 48 and the portion 52 of the upper lid 30 acts as a mechanical lever to lift the upper lid 30 upward into the collapsed position (see FIG. 1C) or downward into the erected position (see FIG. 1A). The upper lid 30 may also have a support in the form of the bar 46 that holds the upper lid 30 in the horizontal position when the foldable storage compartment is in the erected position.

It is also contemplated that the vertical linkage 40 may be attached to either one of the first and second sides of the first and second shelves 36, 38.

Figure 2:
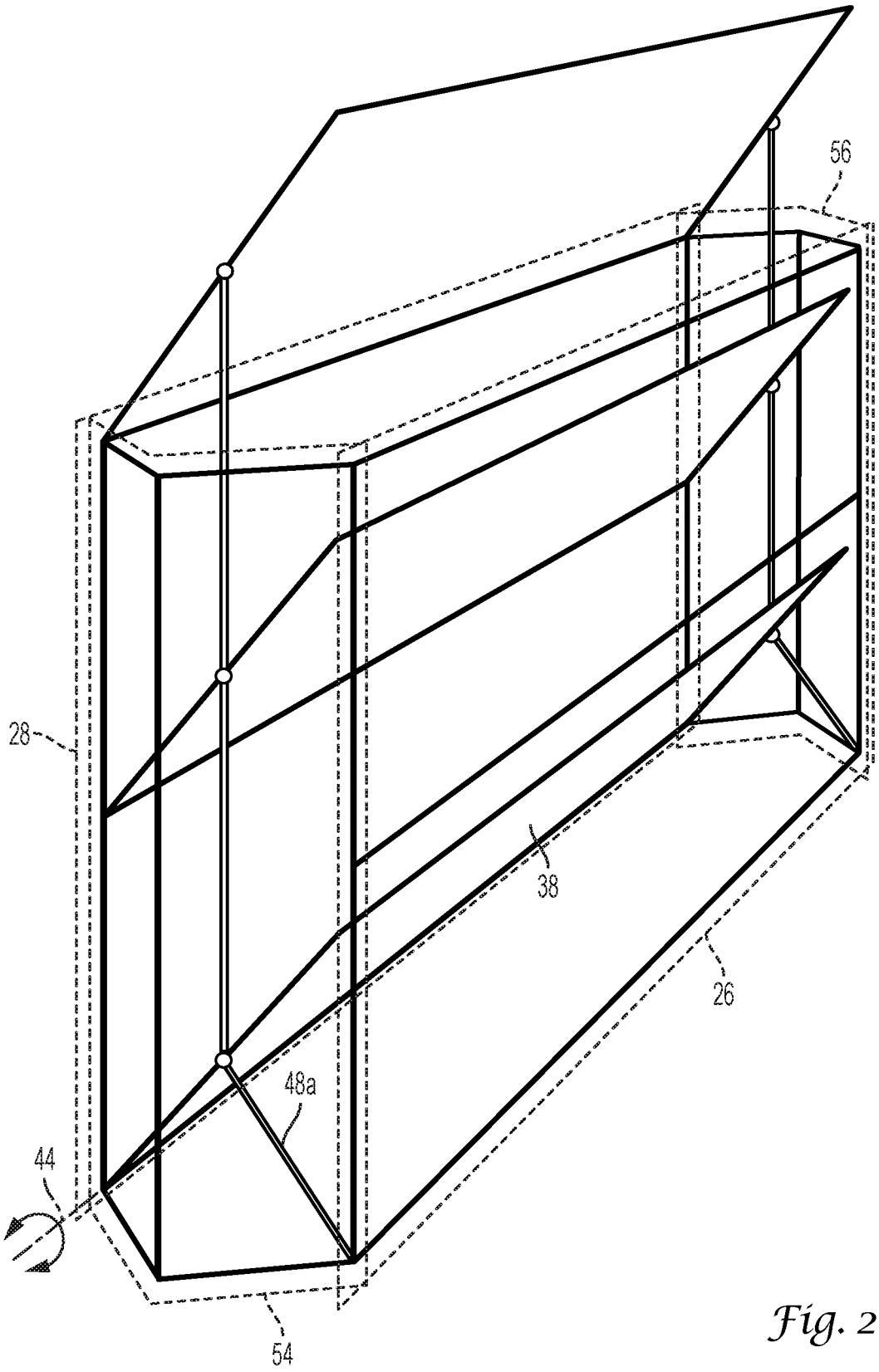
FIG. 2 is a perspective view of a first variant of the foldable storage compartment shown in FIG. 1.
Figure 3:
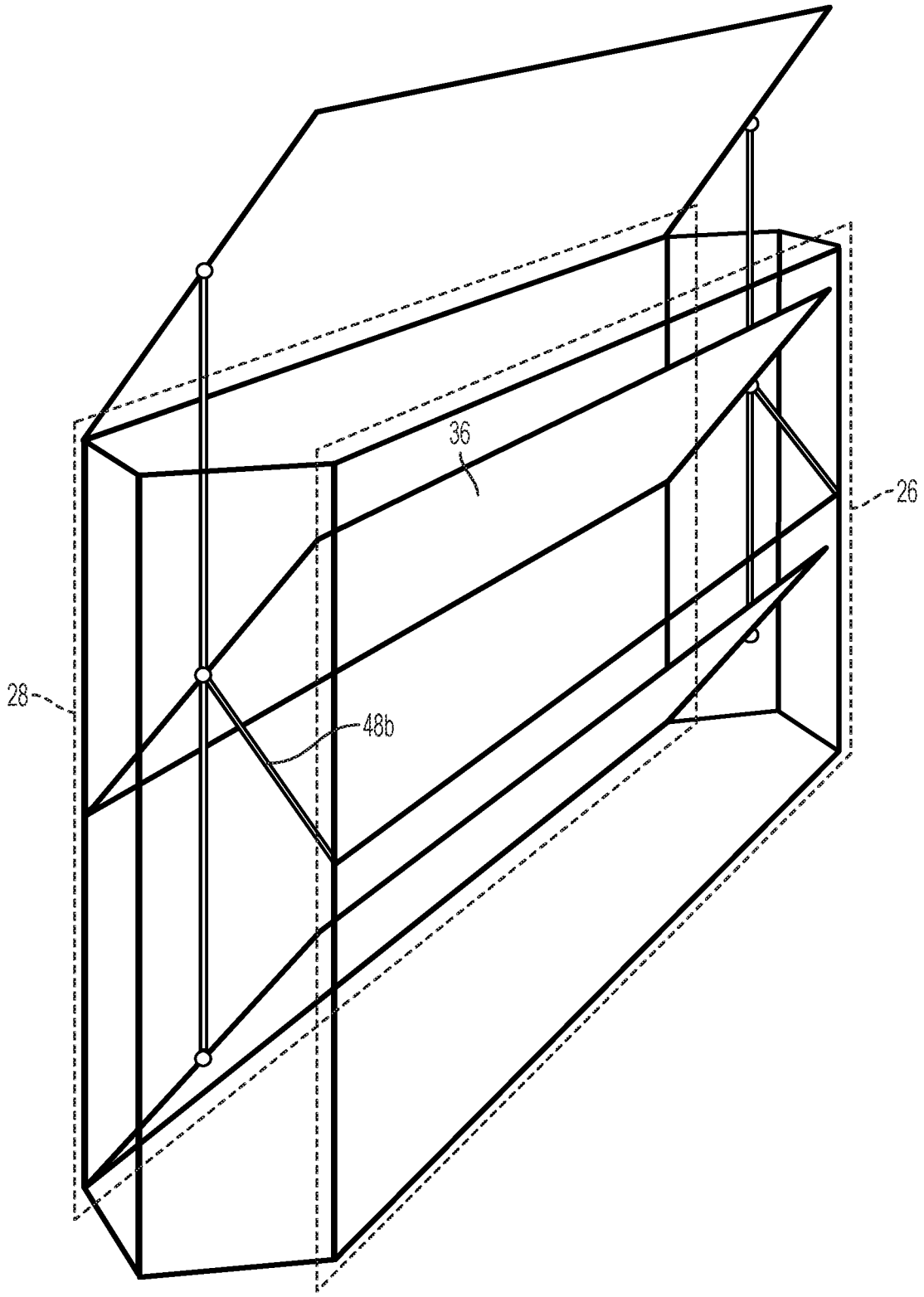
FIG. 3 is a perspective view of a second variant of the foldable storage compartment shown in FIG. 1.
Figure 4:
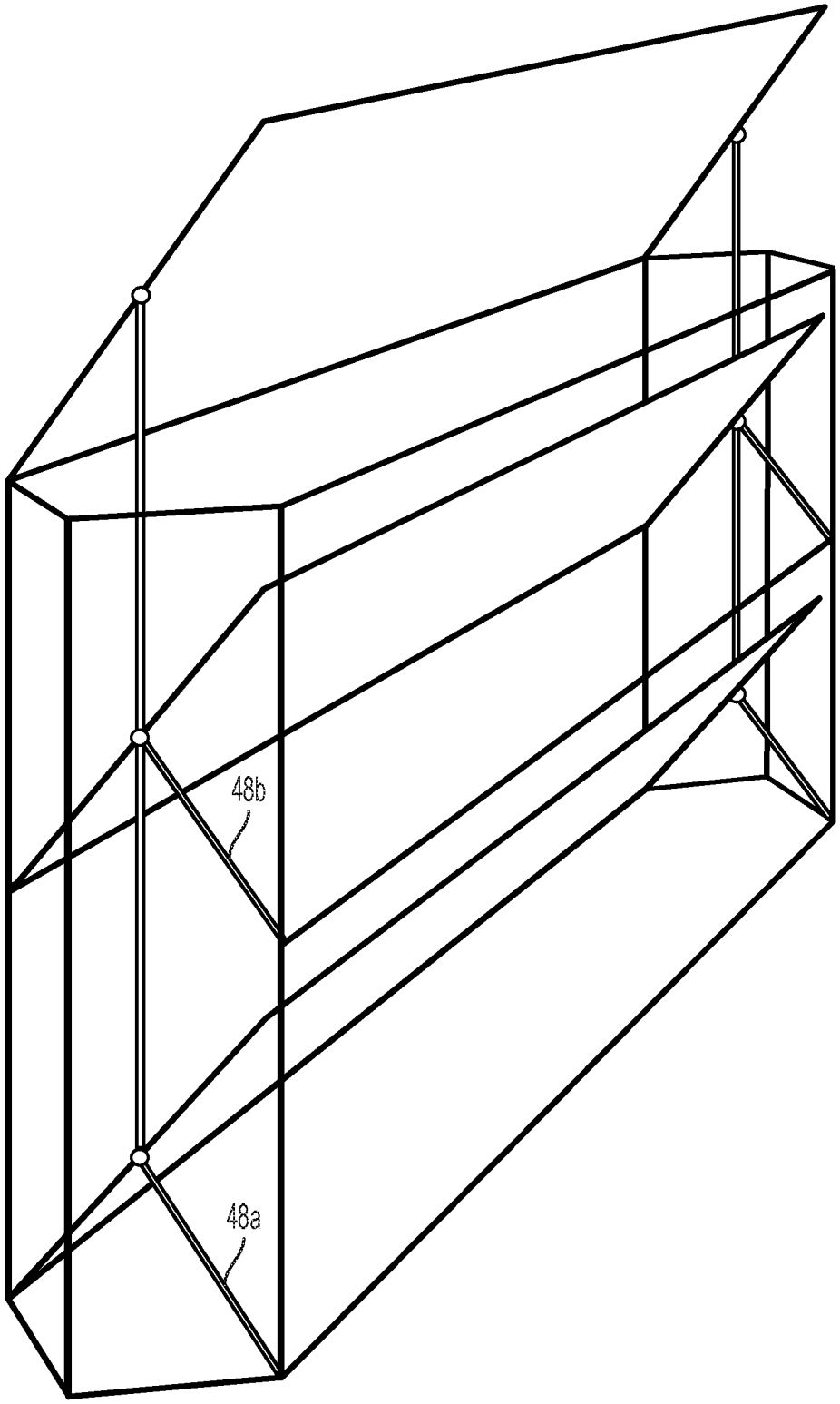
FIG. 4 is a perspective view of a third variant of the foldable storage compartment shown in FIG. 1.
Figure 5:
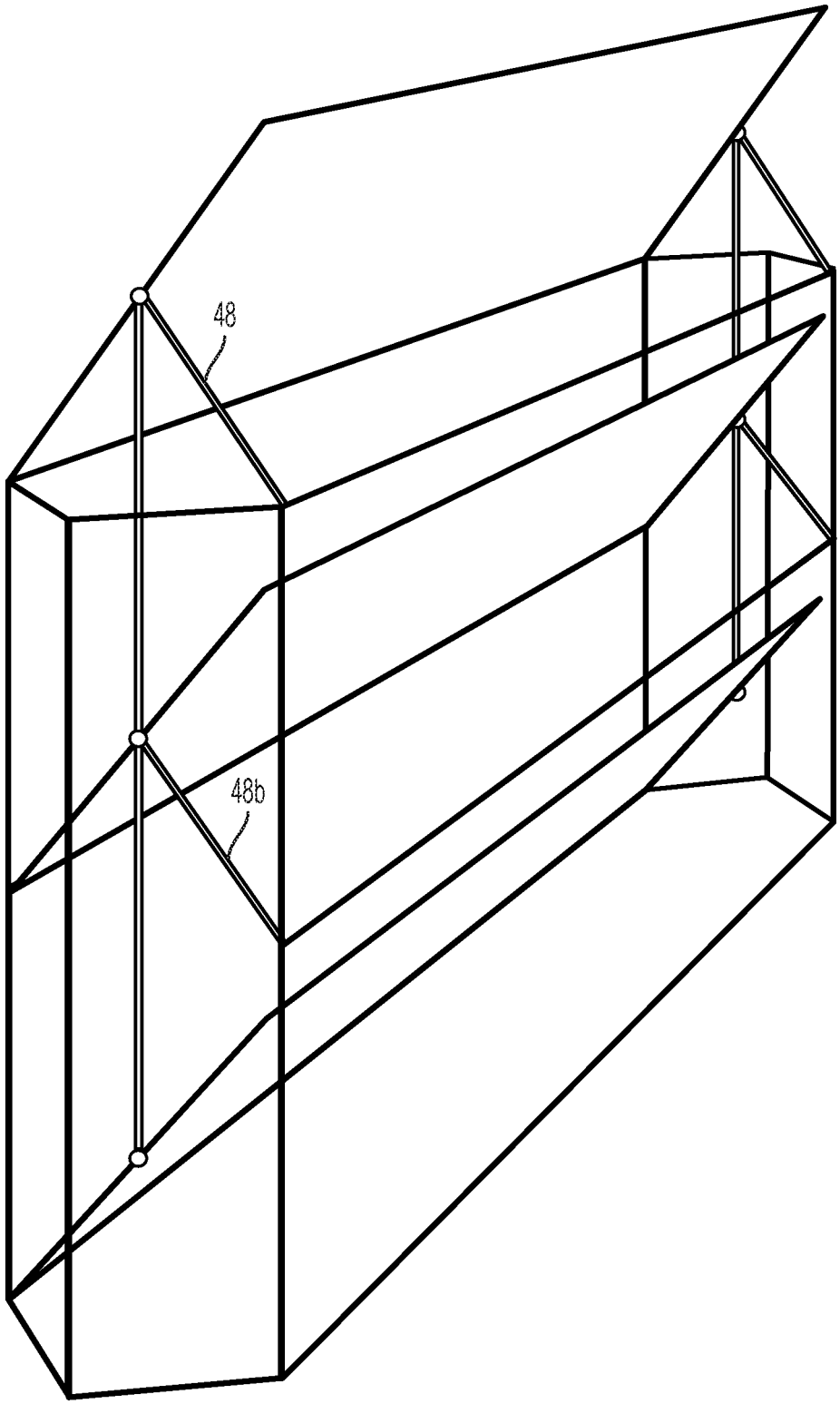
FIG. 5 is a perspective view of a fourth variant of the foldable storage compartment shown in FIG. 1.
Figure 6:
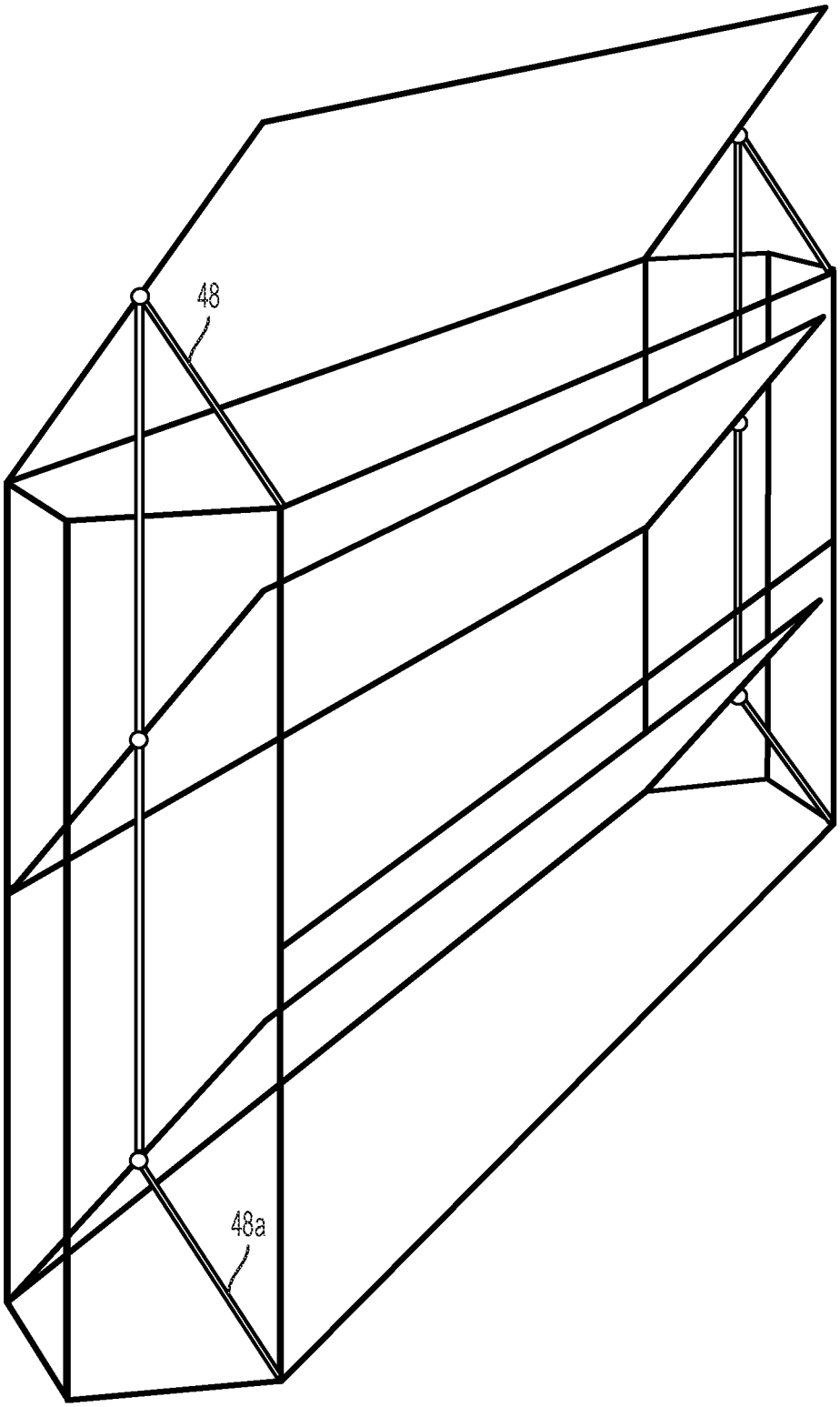
FIG. 6 is a perspective view of a fifth variant of the foldable storage compartment shown in FIG. 1.
Figure 7:
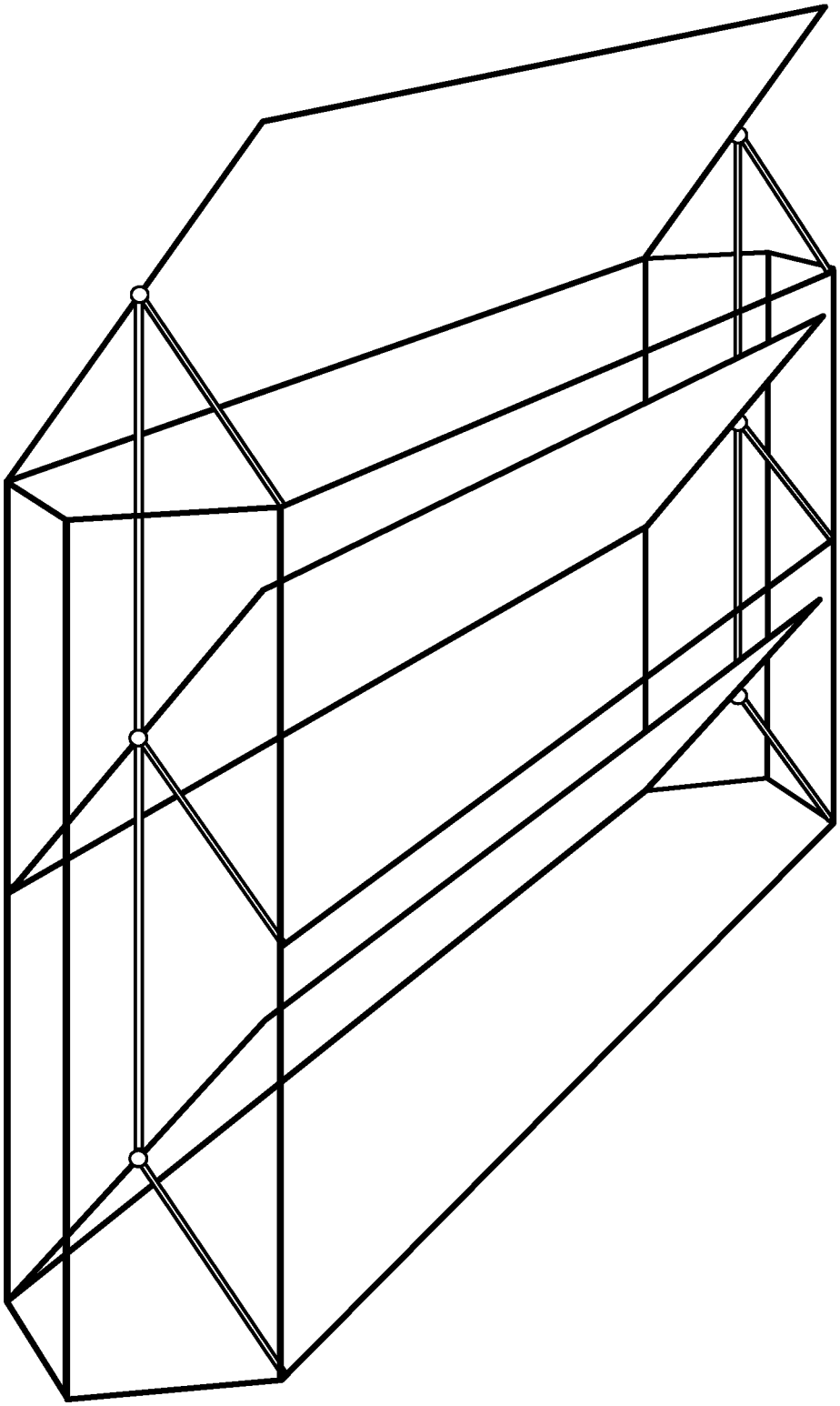
FIG. 7 is a perspective view of a sixth variant of the foldable storage compartment shown FIG. 1.

The front panel linkage 48 may be located at different points. By way of example and not limitation, FIG. 2 illustrates a front panel linkage 48*a* secured or pivotally attached to the front panel 26 at a corresponding vertical height of the rotational axis 44 of the second shelf 38. Additionally, the front panel linkage 48*a* may be pivotally attached to a midpoint of the second shelf 38 as defined by the distance between the front and rear panels 26, 28. FIG. 3 illustrates a front panel linkage 48*b* secured or pivotally attached to the front panel at a corresponding vertical height of the rotational axis 42 of the first shelf 36. Additionally, the front panel linkage 48*b* may be pivotally attached to a midpoint of the first shelf 36 as defined by the distance between the front and rear panels 26, 28. More than one front panel linkage 48 may be utilized. By way of example and not limitation, FIG. 4 illustrates two front panel linkages 48*a*, 48*b* on each side of the shelves 36, 38. FIG. 5 illustrates front panel linkages 48, 48*b* incorporated into the foldable storage compartment. FIG. 6 illustrates front panel linkages 48, 48*a* incorporated into the foldable storage compartment. FIG. 7 illustrates front panel linkages 48, 48*a*, 48*b* incorporated into the foldable storage compartment.

Referring now to FIGS. 23-26, the foldable storage compartment 10 may also have collapsible first and second sidewalls 54, 56. The collapsible first and second sidewalls 54, 56 may be pivotally attached to the front and rear panels 26, 28. The first and second sidewalls 54, 56 may pivot about rotational axes 58, 60 with respect to the front and rear panels 26, 28. Additionally, the first and second sidewalls 54, 56 may be folded or pivoted by folding the first and second sidewalls 54, 56 in half about its midpoint which is shown by rotational axis 62.

The front and rear panels 26, 28 may have identical structures. By way of example and not limitation, the front and rear panels 26, 28 may be a square or rectangular wireframe with the bars 46 horizontally attached to opposed vertically positioned wire bars. Alternatively, the front and rear panels 26, 28 may be a wooden board with apertures formed therethrough to access the first and second shelves when the foldable storage compartment 10 is in the erected position. Those apertures may be covered with one or more doors 27, 29 (see FIG. 29) that can be opened and closed when the foldable storage compartment 10 is in the erected position. The front and rear panels 26, 28 may be fabricated from other materials including but not limited to a wire rod frame covered with a flexible covering (e.g., cloth), wooden board, cardboard panel, rigid wire mesh, or combinations thereof. The door may be positioned to access or provide access to the first shelf. A second door may be positioned to provide access to the second shelf. The door may be closed and locked and may be opened as desired by the user.

The upper lid 30 may also function as a shelf. If the upper lid 30 functions as a shelf, the upper lid 30 may be fabricated from a generally flat member such as a wooden board, metal plate, mesh, rigid mesh material such as a wire or rigid wire mesh material, wire rod frame with a flexible covering (e.g., cloth) or combinations thereof.

The first and second sidewalls 54, 56 may also be solid or fabricated from a wireframe. If the first and second sidewalls 54, 56 are fabricated from solid material, then they 54, 56 may be designed to be collapsed or pivoted at its midpoint about rotational axis 62 and be joined to the front and rear panels 26, 28 at the rotational axes 58, 60.

Figure 23:
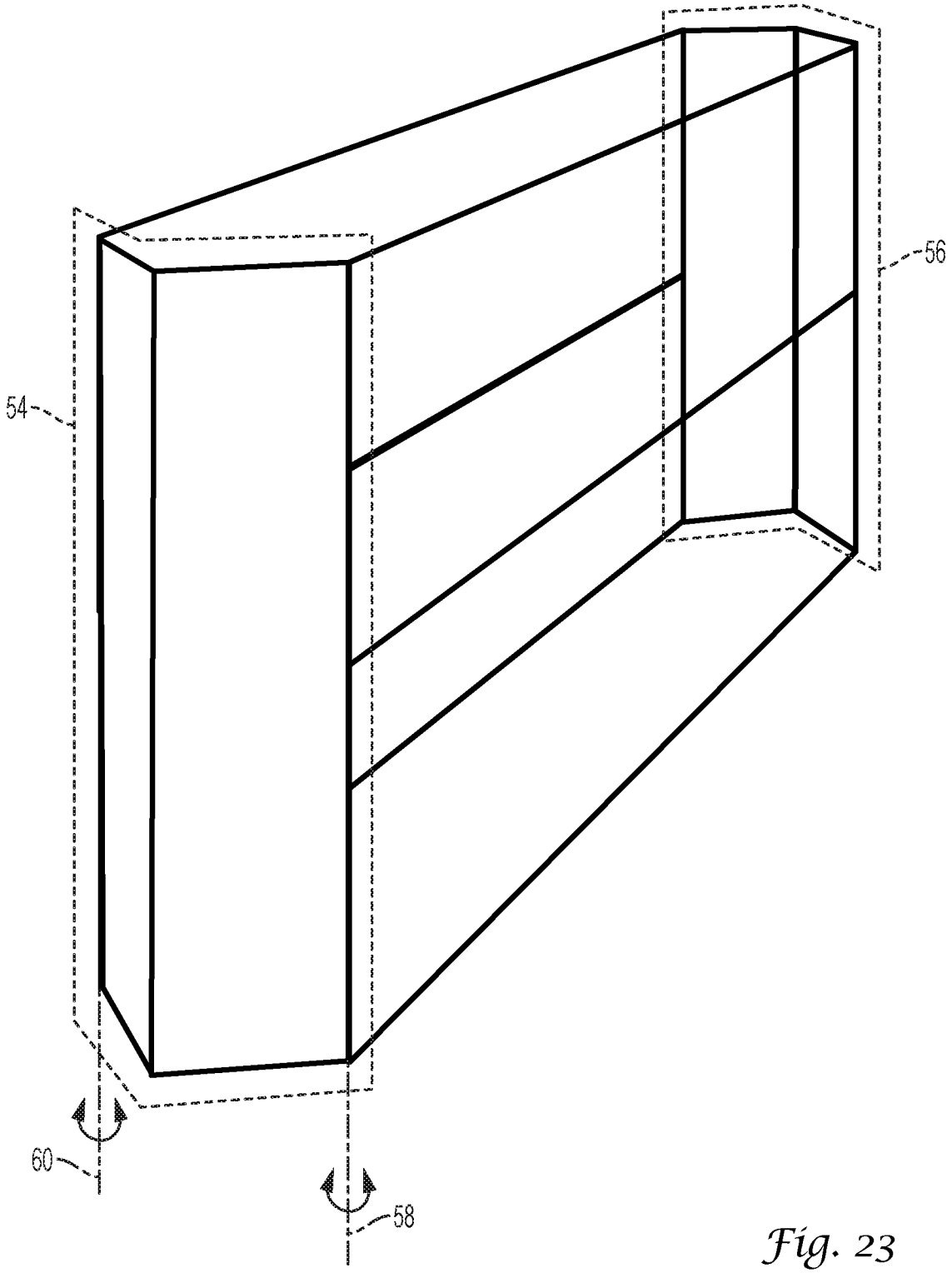
FIG. 23 illustrates side panels foldable at a midpoint.
Figure 24:
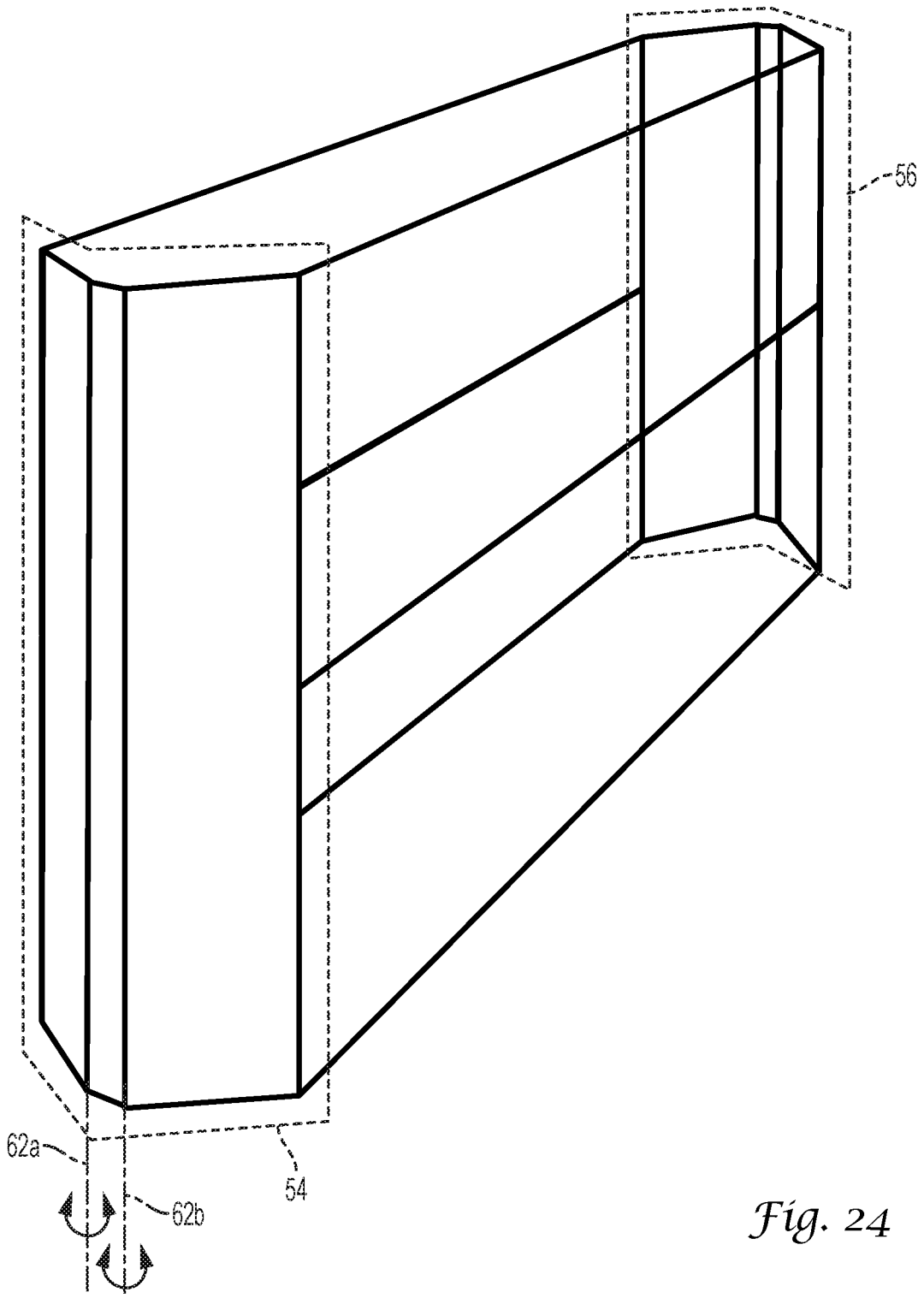
FIG. 24 illustrates side panels of a foldable storage compartment foldable at multiple rotational axes.
Figure 25:
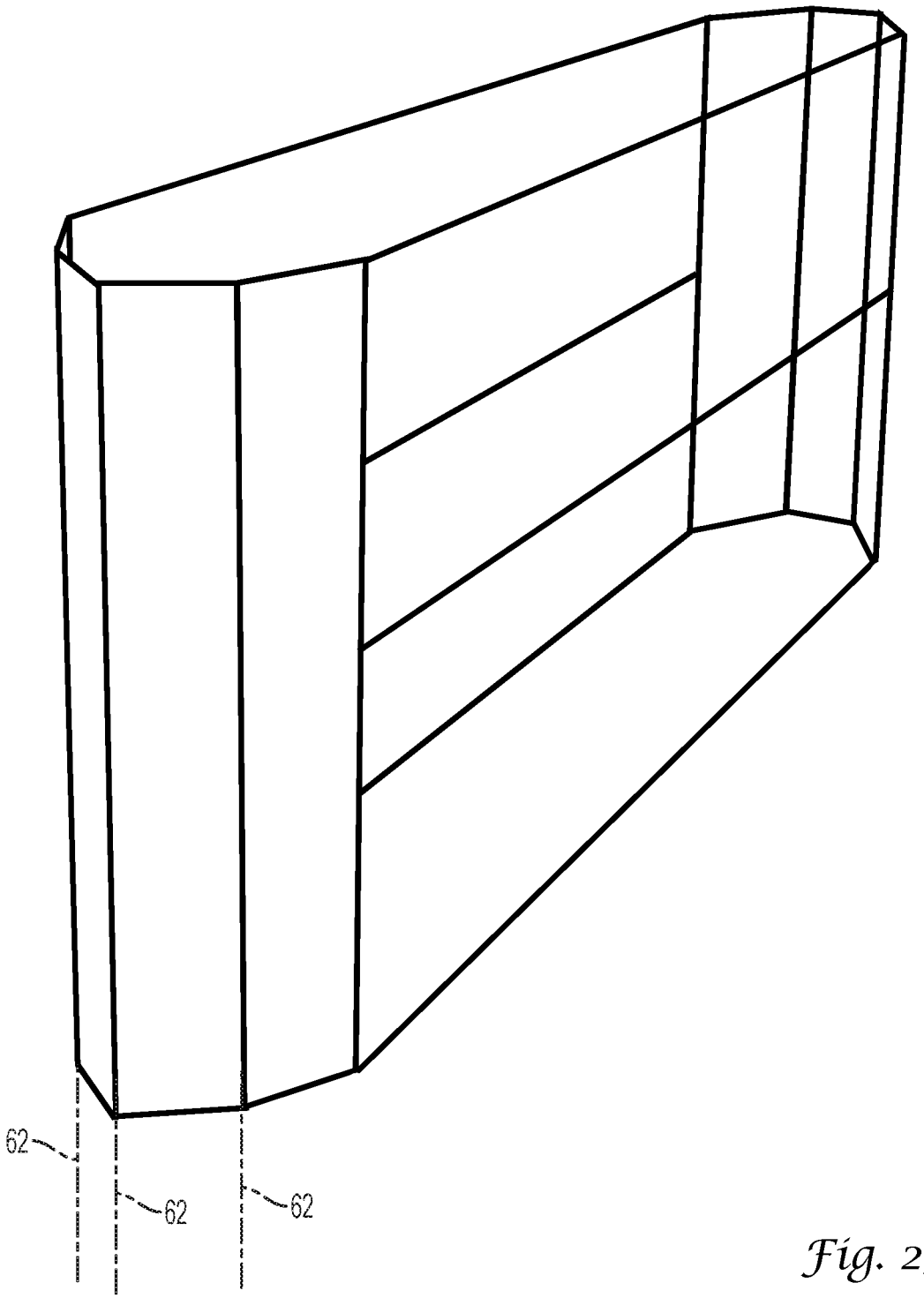
FIG. 25 illustrates side panels of a foldable storage compartment foldable about more multiple rotational axes compared to FIG. 26.
Figure 26:
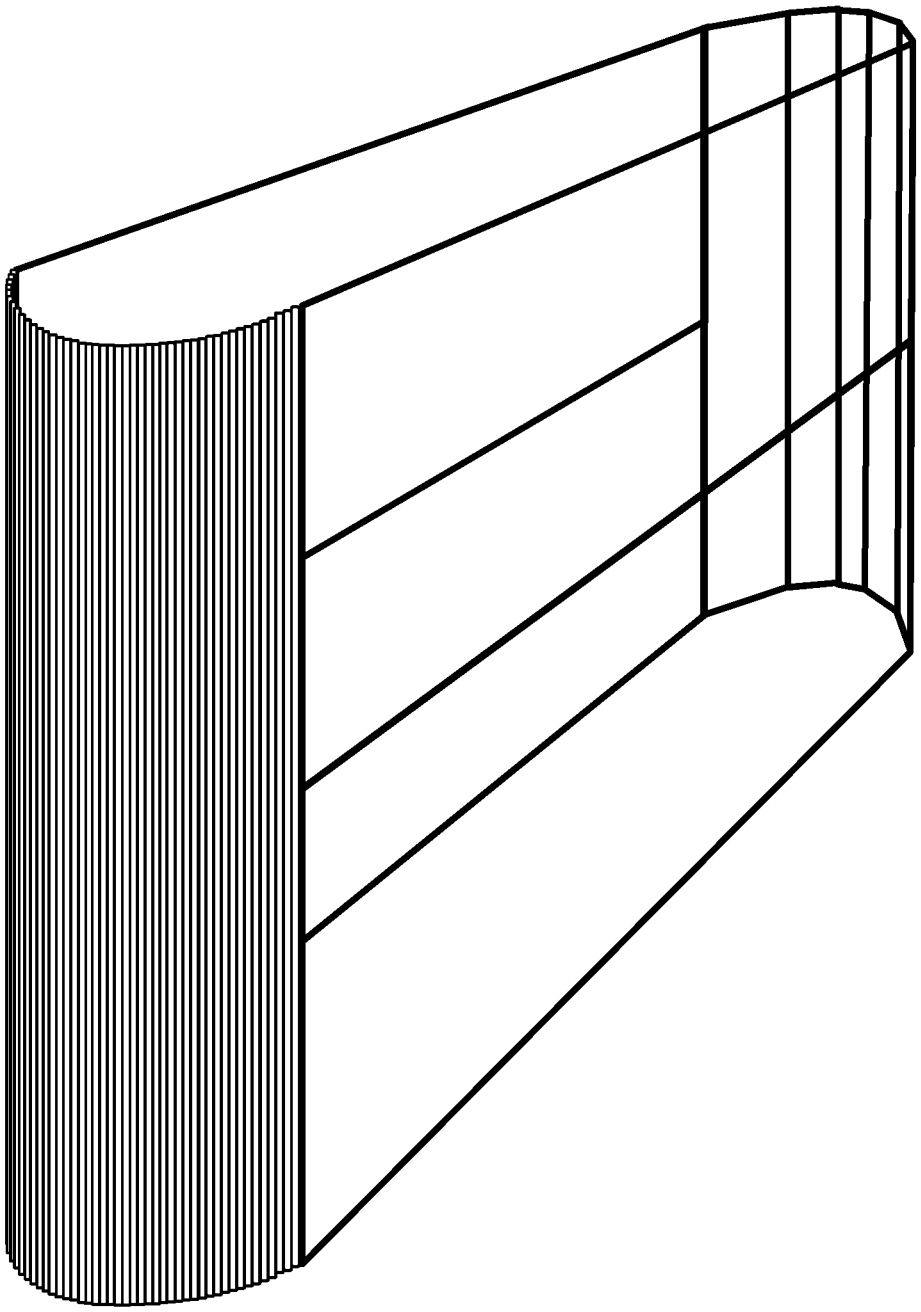
FIG. 26 illustrates side panels of a foldable storage compartment foldable about more multiple rotational axes compared to FIG. 27.

The first and second sidewalls 54, 56 may each be designed to collapse as two parts as shown in FIGS. 1-23, 29 and 30. However, it is also contemplated that the first and second sidewalls 54, 56 may have more than one pivot axes about which the first and second sidewalls number 54, 56 collapses as shown in FIGS. 24-26. For example, in FIG. 24, the first and second sidewalls 54, 56 collapse or pivots about rotational axes 62*a*, 62*b*. FIGS. 25 and 26 illustrates that the first and second sidewalls 54, 56 may have a plurality of rotational axes. Rotation about the rotational axes facilitate the collapse of the first and second sidewalls 54, 56. Moreover, the first sidewall 54 may have more or equal number rotational axes 62*a*-*n* about which the first sidewall 54 collapses compared to the number of rotational axes 62*a*-*n* of the second sidewall 56 about which the second sidewall 56 collapses and vice versa. In FIGS. 23 and 25, the first and second sidewalls 54, 56 collapses midway between the front and rear panels 26, 28 in that the rotational axis is located at the middle or halfway distance between the front and rear panels 26, 28. In FIG. 24, the first and second sidewalls 54, 56 collapses midway between the front and rear panels 26, 28 in that the rotational axes 62*a*, 62*b* is located at a mid portion between the front and rear panels 26, 28.

When the foldable storage compartment 10, 12, 16, 18, 20, 22, 24 is in the erected position, the first and second sidewalls 54, 56 may be fully extended flat and help to stabilize the foldable storage compartment 10-24 in the narrow direction identified by arrow 64 (see FIG. 1). The front and rear panels 26, 28 may be fabricated from a square or rectangular tubular or wire rod member or solid panel so that the foldable storage compartment is stabilized in the long direction identified by arrow 66.

The foldable storage compartments 10, 12, 16, 18, 20, 22, 24 may have various sides or surfaces. By way of example not limitation, the portable storage compartment 10-24 may have front and rear panels 26, 28, first and second panels 68, 70 that rotate about each other and form the first and second sidewalls 54, 56, shelves 36, 38 and upper lid 30. The sides or surfaces are not necessarily limited to solid panels. However, these sides and surfaces may be fabricated from a rectangular or tubular member. Alternatively, the sides or surfaces may be fabricated from a solid sheet of plywood, rigid cardboard, paperboard, plastic, metal, corrugated construction, medium density fiberboard, wire rod frame with a flexible covering (e.g., cloth) or combinations thereof. It is also contemplated that the sides and surfaces may be fabricated from a wire mesh material, a plurality of wire rods set in an arrangement of crisscross array of wire rods. The rotational movement between the first and second sidewalls 54, 56 to the front and rear panels 26, 28 may be accomplished with a piano hinge disposed between the respective sides and surfaces, a door hinge, a living hinge, etc. Moreover, the rotational movement between the shelves 36, 38 and the upper lid 30 to the rear panel 28 may be accomplished with a piano hinge, door hinge, living hinge, pegs and holes wherein the pegs rotate within the holes, etc. The vertical linkage bar 40 may be attached to the shelves 36, 38 and the upper lid 30 on opposed edges as shown in FIG. 1. However, it is also contemplated that one or more vertical linkage bar(s) 40 may be attached at a midpoint of a width or other lateral positions of the shelves 36, 38 and the upper lid 30 by forming aperture(s) through the shelves 36, 38 and the upper lid 30 and disposing the vertical linkage bar(s) 40 through the aperture(s). The vertical linkage bar 40 may be attached to the shelves 36, 38 and the upper lid 30 with a ball and socket connection, rotatable knuckle, etc. The front panel linkage may be attached to the upper lid 30 as shown in FIG. 1. However, it is also contemplated that the front panel linkage 48 may be attached at a midpoint of the width of the shelves 36, 38 and the upper lid 30 by disposing the front panel linkage 48 at a midpoint of the upper lid 30 and the upper edge or portion of the front panel 24.

Figure 8:
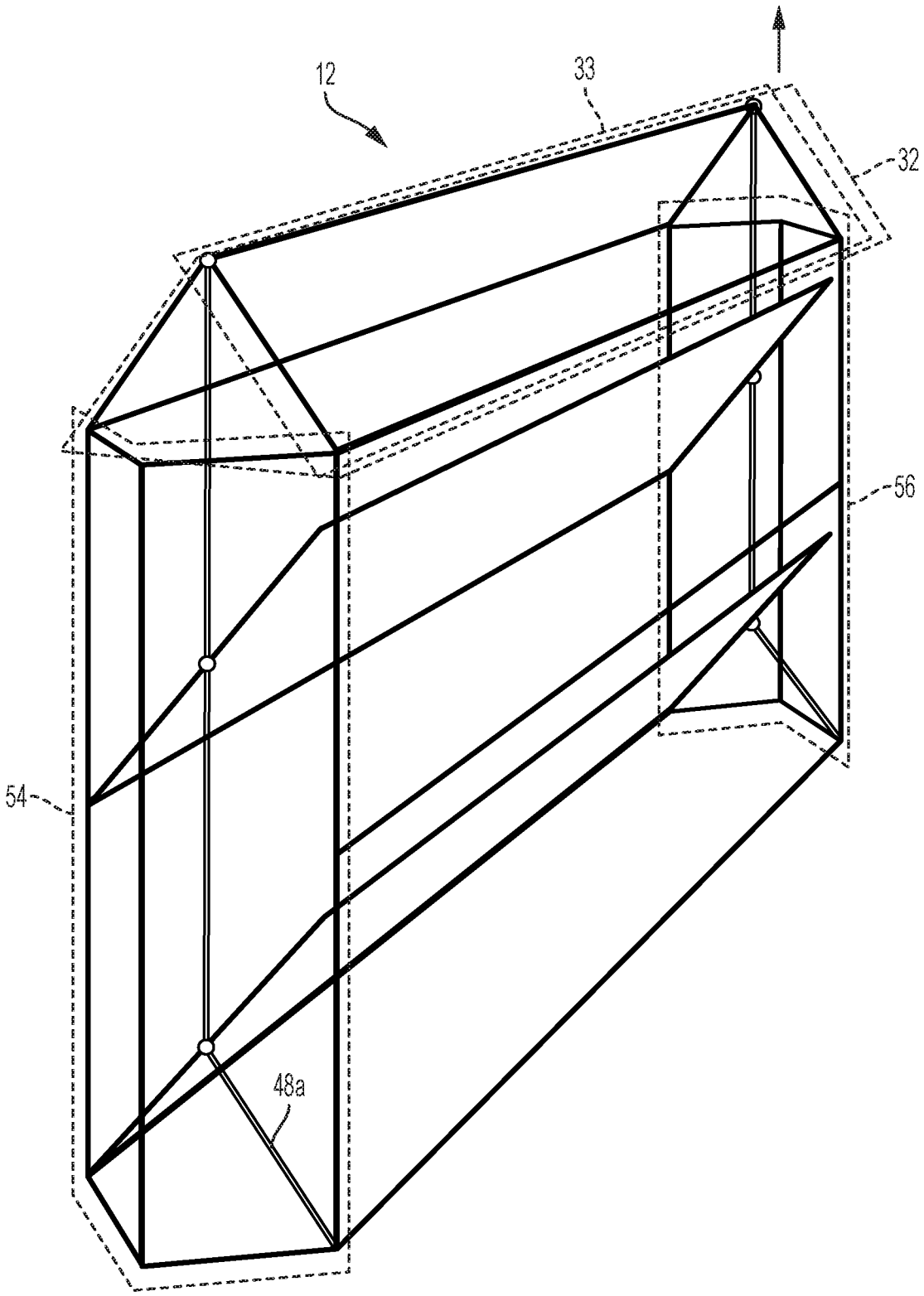
FIG. 8 is a perspective view of a second embodiment of the foldable storage compartment.
Figure 8A:
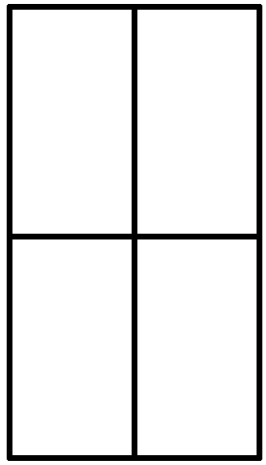
FIG. 8A is a side view of the foldable storage compartment shown in FIG. 8 in the erect position.
Figure 8B:
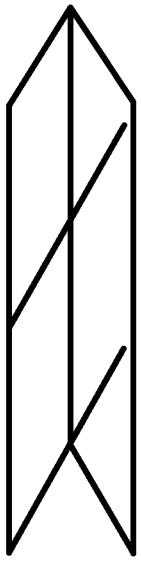
FIG. 8B is a side view of the foldable storage compartment shown in FIG. 8 being collapsed.
Figure 8C:
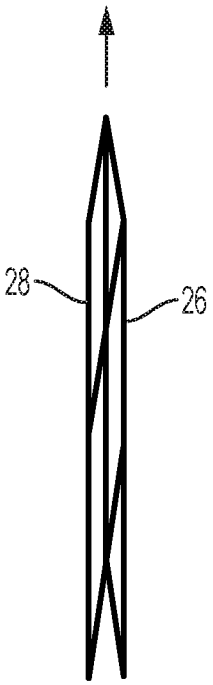
FIG. 8C is a side view of the foldable storage compartment shown in FIG. 8 in the collapsed position.
Figure 9:
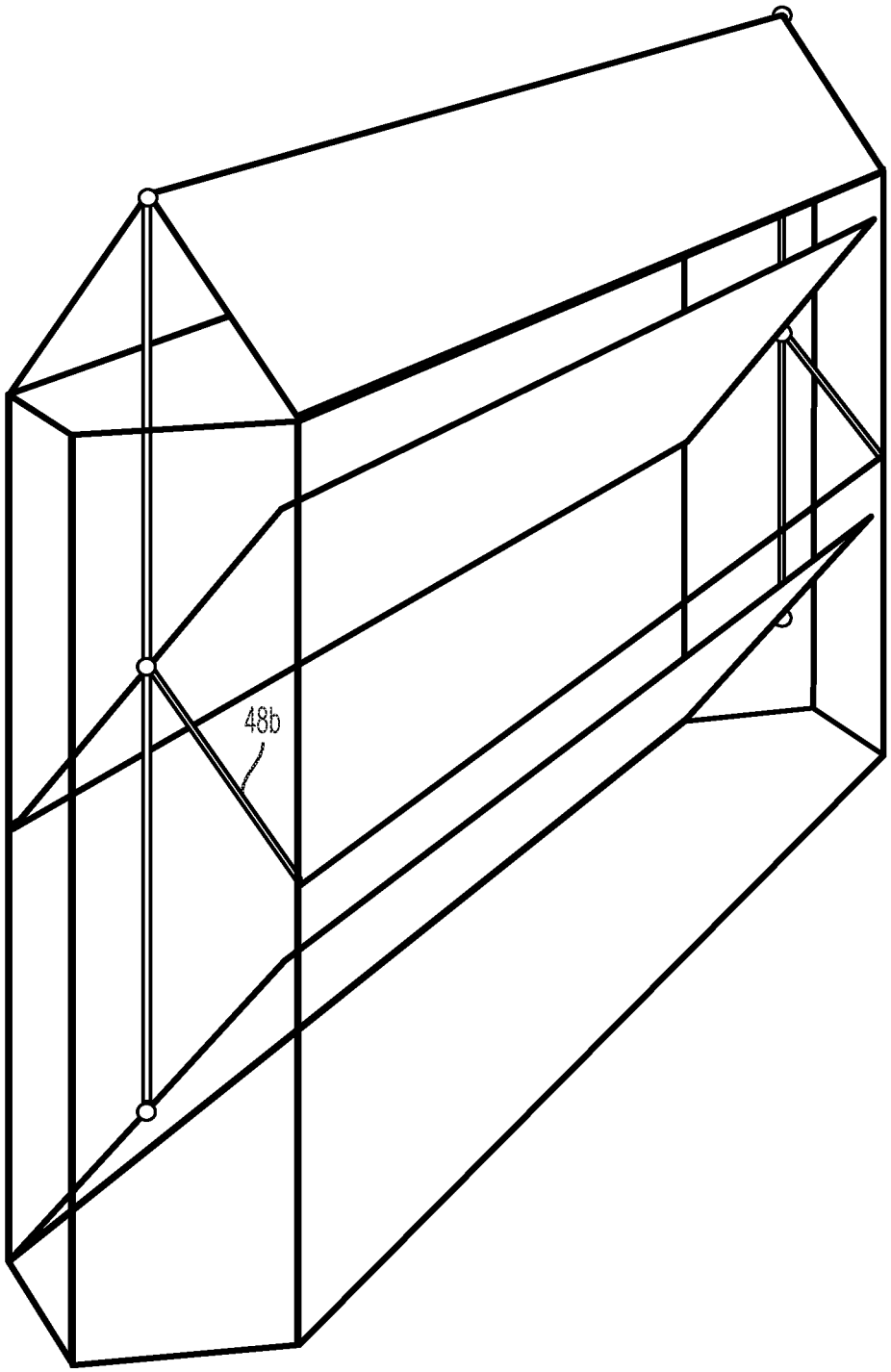
FIG. 9 is a perspective view of a first variant of the foldable storage compartment shown in FIG. 8.
Figure 10:
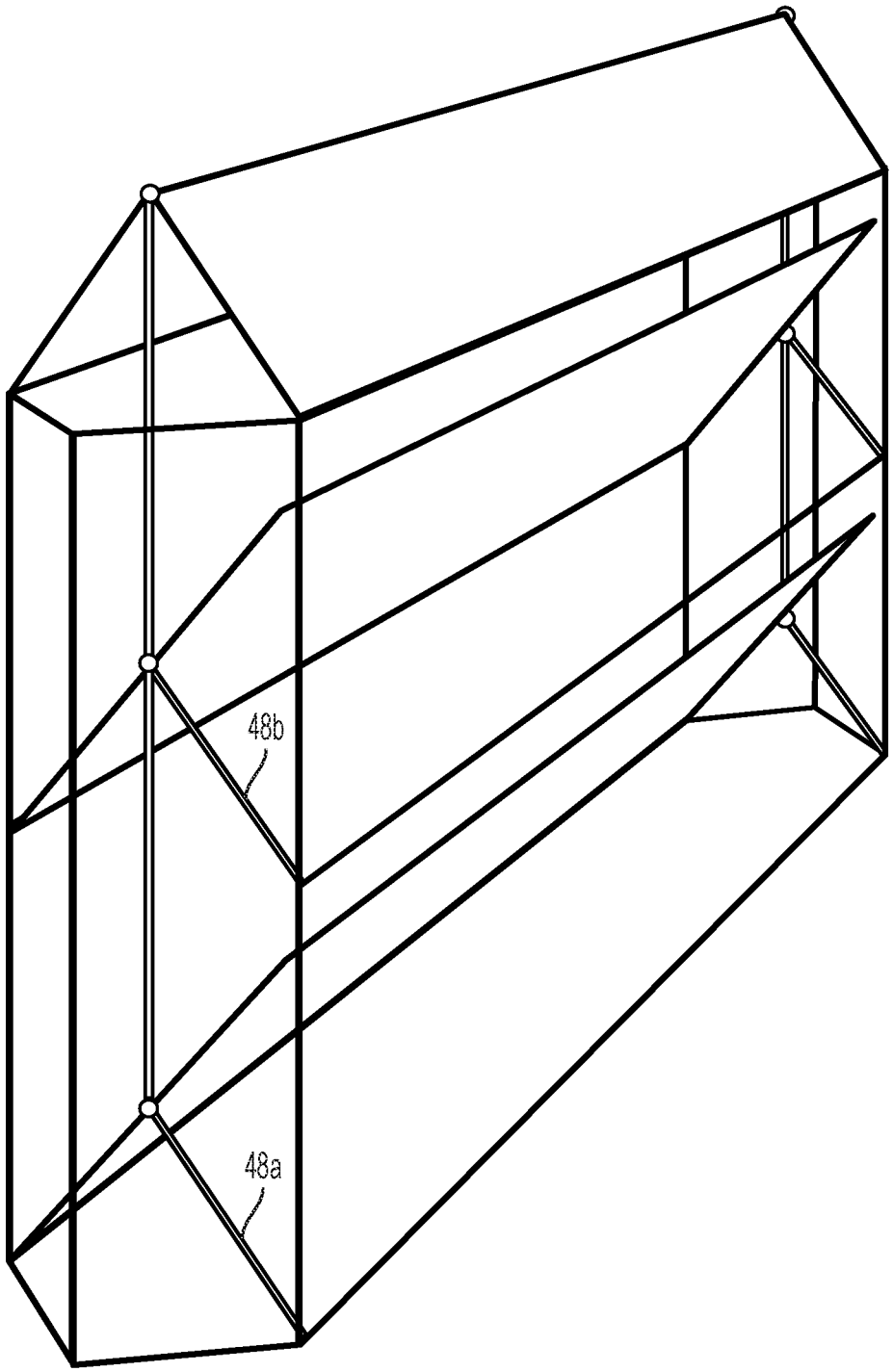
FIG. 10 is a perspective view of a second variant of the foldable storage compartment shown in FIG. 8.

Referring now to FIG. 8, the lid 32 may be foldable. The lid 32 may fold at a midpoint. FIGS. 8A-8C illustrate the foldable storage compartment 12 being collapsed and when viewed in the reverse order being erected. The lid 32 may be solid panels or the lid 32 may be formed with a wire rod. The foldable storage compartment 12 may have a front panel linkage 48*a* (see FIG. 8), 48*b* (see FIG. 9). FIG. 10 illustrates the foldable storage compartment 12 with front panel linkages 48*a*, 48*b*. One half 33 of the lid 32 may serve the same function as front panel linkage 48. The foldable storage compartment 12 except for the lid 32 in how it functions with the rest of the foldable storage compartment 12 may incorporate the rest of the foldable storage compartment 10-24 described herein.

Figure 11:
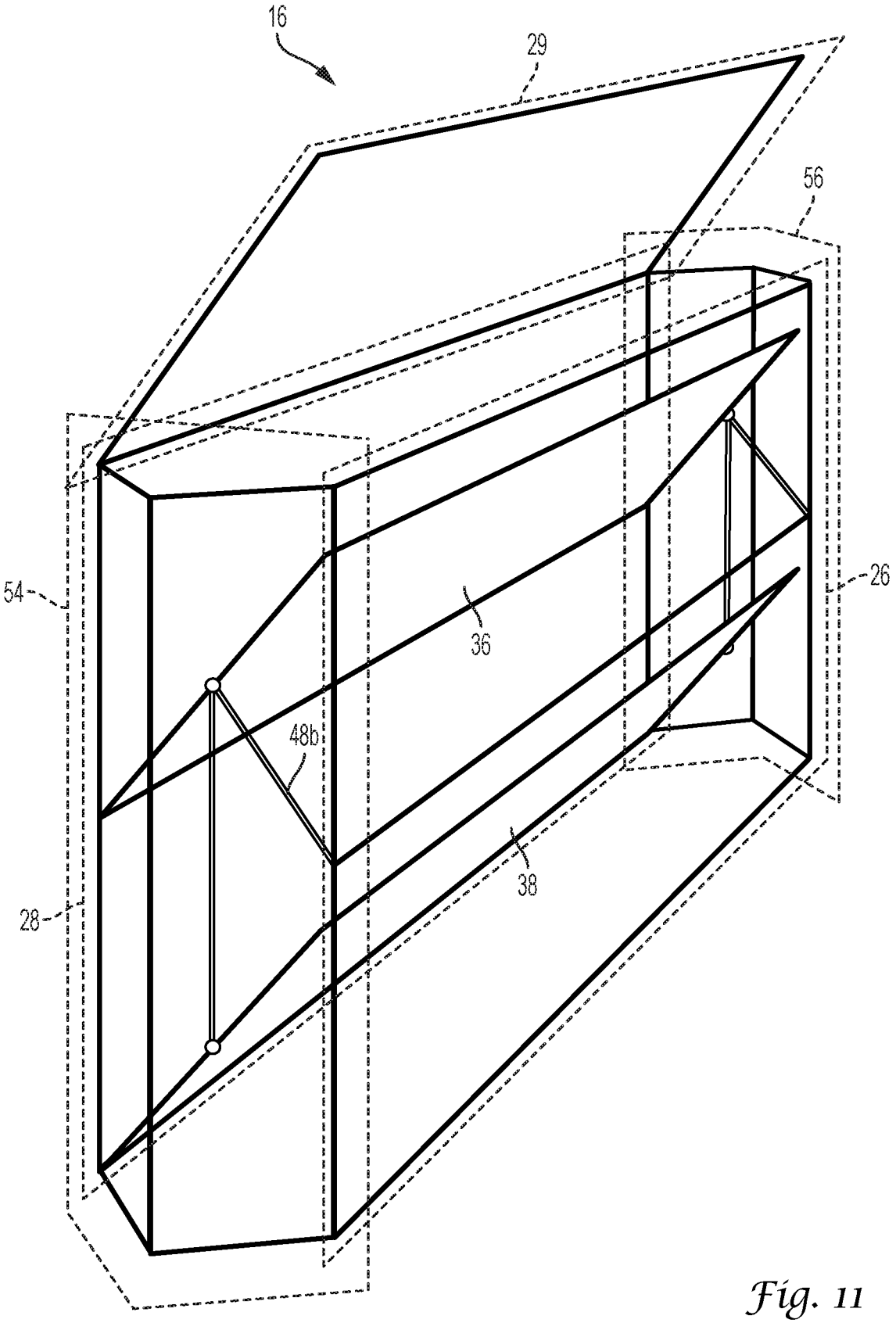
FIG. 11 is a perspective view of a third embodiment of the foldable storage compartment.
Figure 11A:
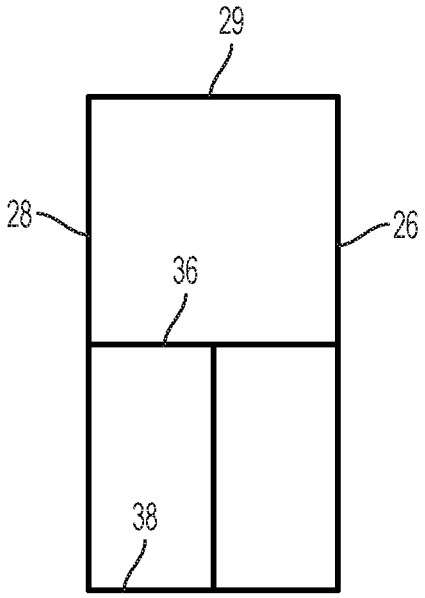
FIG. 11A is a side view of the foldable storage compartment shown in FIG. 11 in the erect position.
Figure 11B:
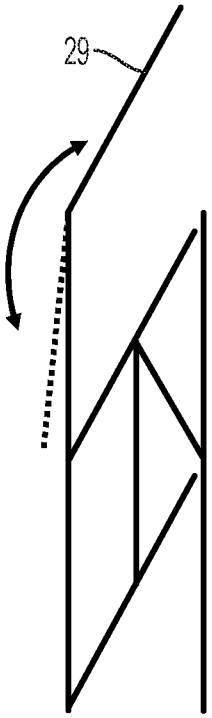
FIG. 11B is a side view of the foldable storage compartment shown in FIG. 11 being collapsed.
Figure 11C:
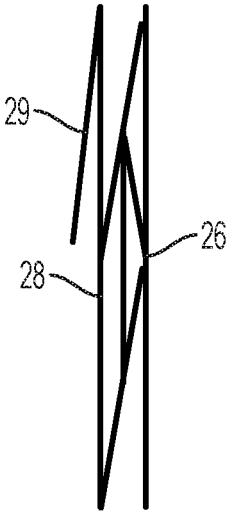
FIG. 11C is a side view of the foldable storage compartment shown in FIG. 11 in the collapsed position.
Figure 12:
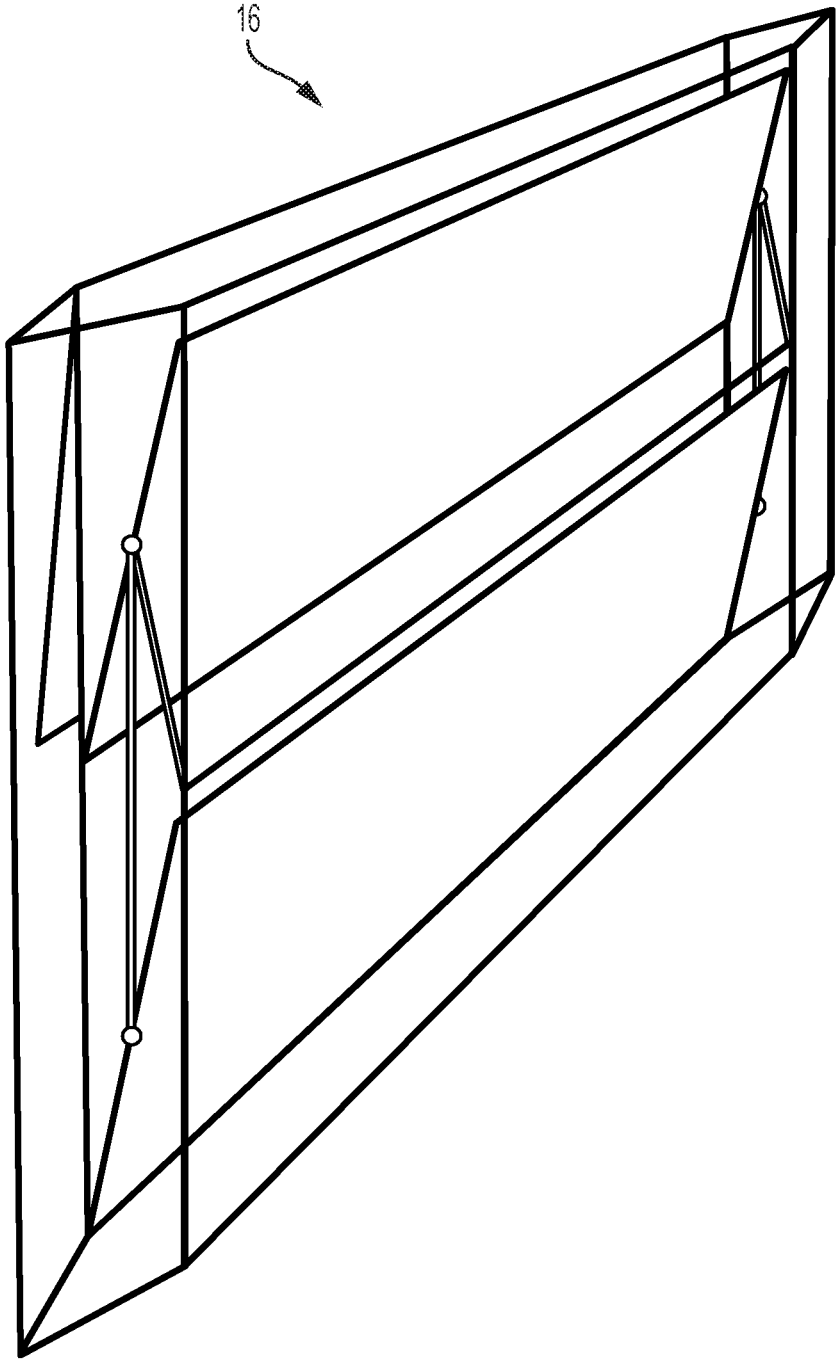
FIG. 12 is a perspective view of the foldable storage compartment shown in FIG. 11 being collapsed.
Figure 13:
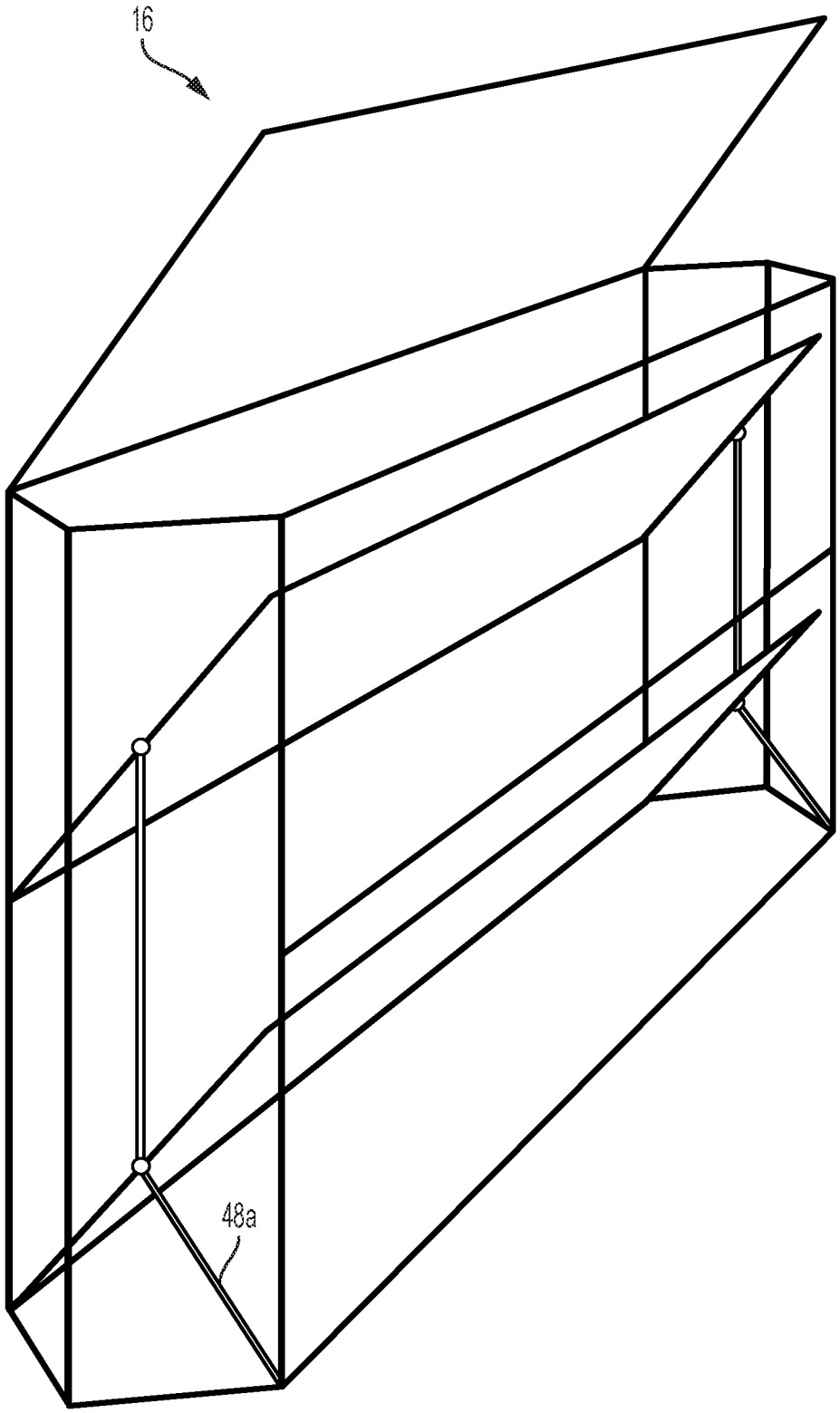
FIG. 13 is a perspective view of a third embodiment of the foldable storage compartment.
Figure 14:
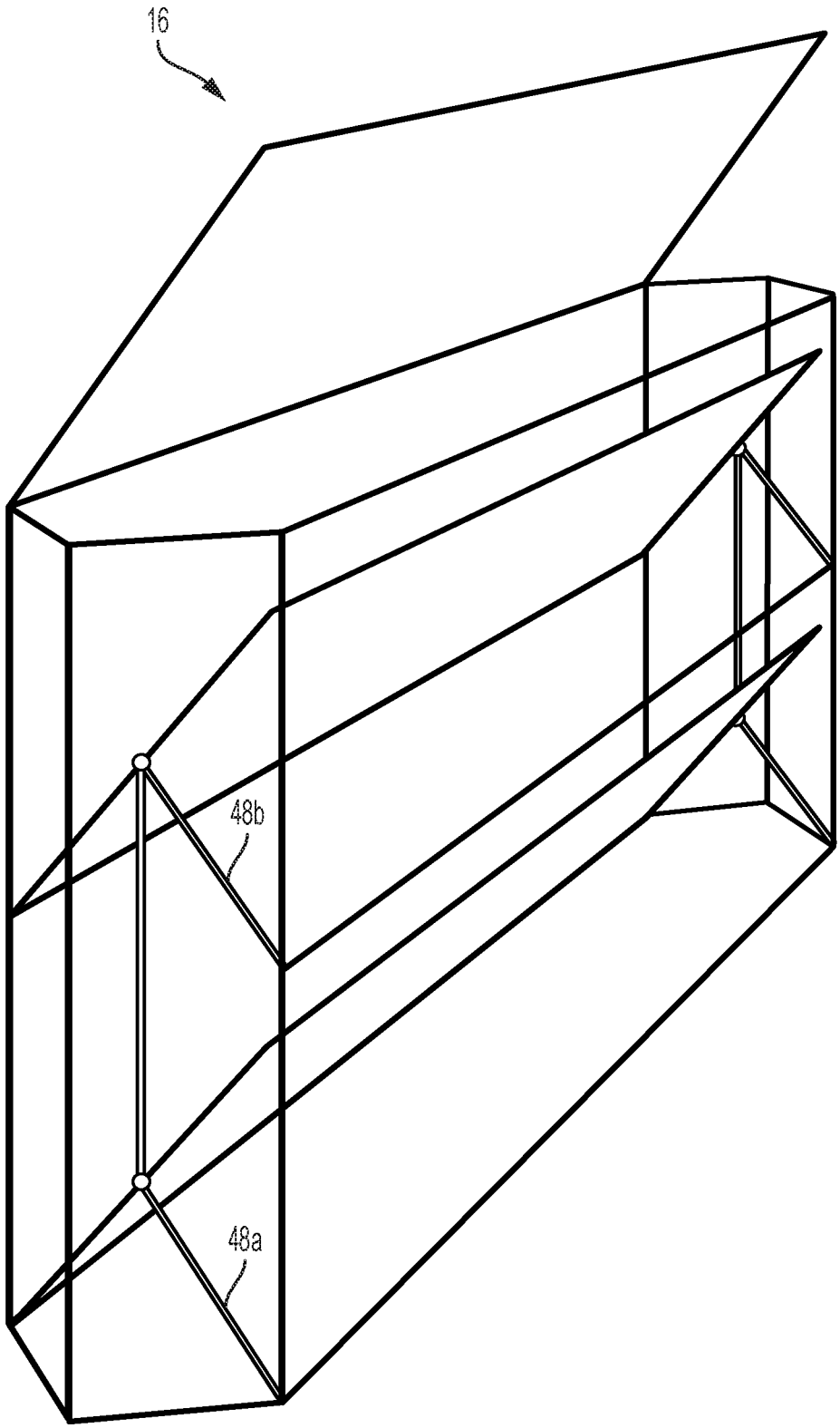
FIG. 14 is a perspective view of a first variant of the foldable storage compartment shown in FIG. 13.

Referring now to FIG. 11-14, the foldable storage compartment 16 may have the same structure as that of the foldable storage compartments 10-24 shown in FIGS. 1-10 except that the lid 29 is not linked to the shelves 36, 38. The lid 29 is horizontal to the shelves 36, 38 when erected as shown in FIG. 11A. The lid 29 may be folded to the backside adjacent to the rear panel 28 by flipping the lid 29 as shown in FIGS. 11B-11C. In this manner, the foldable storage compartment 16 requires at least two motions in order to collapse or erect the foldable storage compartment 16. The process of erecting and collapsing the foldable storage compartment 16 is shown in FIGS. 11A-11C. The first motion may erect or collapse the shelves 36, 38 and the second motion may erect or collapse the lid 29 or vice versa. FIG. 12 is a perspective view of the collapsed foldable storage compartment 16 shown in FIG. 11C. FIG. 11 illustrates the front panel linkage 48*b*. FIG. 13 illustrates the front panel linkage 48*a*. FIG. 14 illustrates the foldable storage compartment 16 with two front panel linkages 48*a*, 48*b*.

Figure 15:
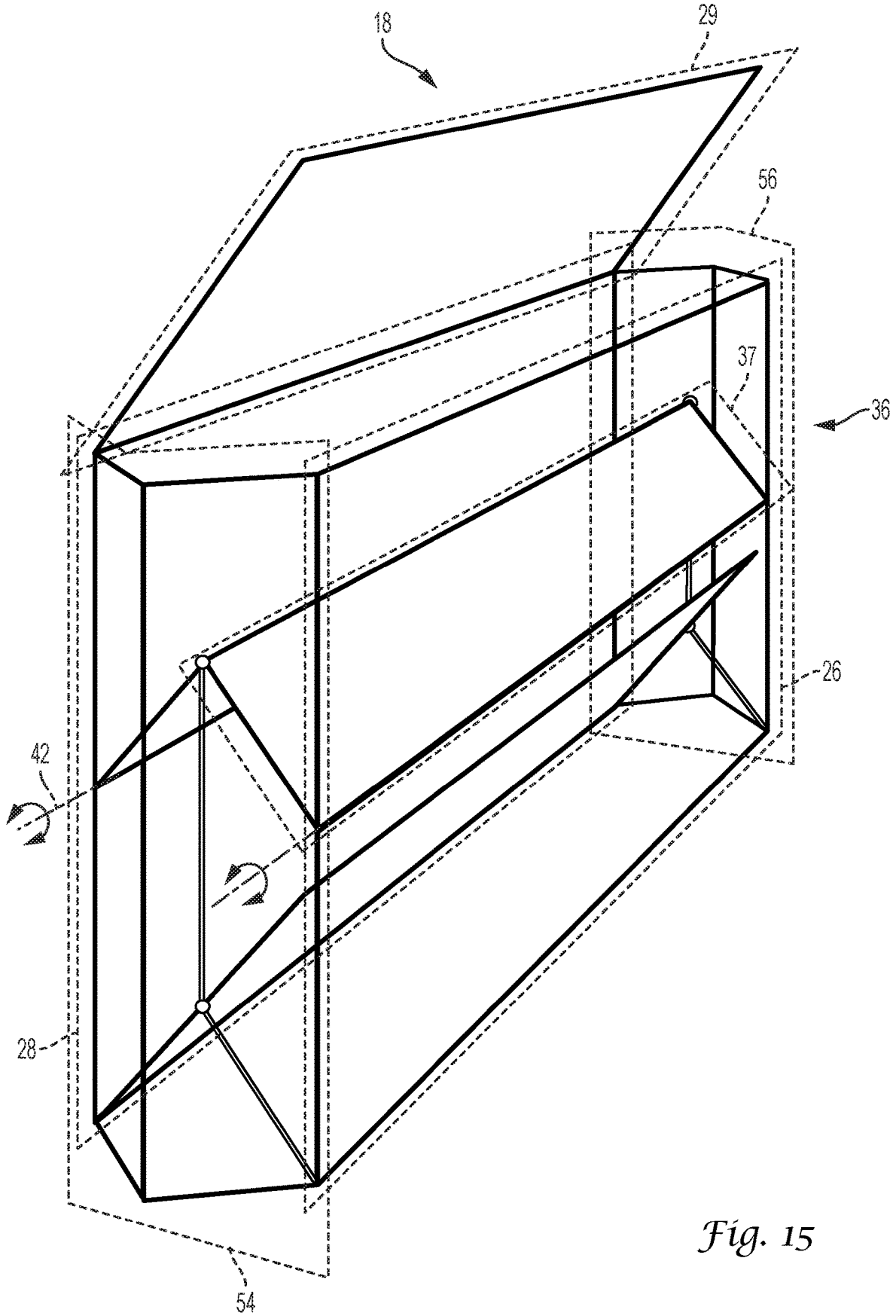
FIG. 15 is a perspective view of a fourth embodiment of the foldable storage compartment.
Figure 15A:
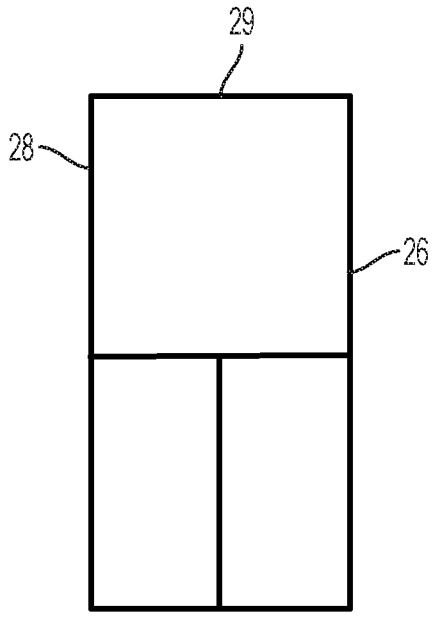
FIG. 15A is a side view of the foldable storage compartment shown in FIG. 15 in the erect position.
Figure 15B:
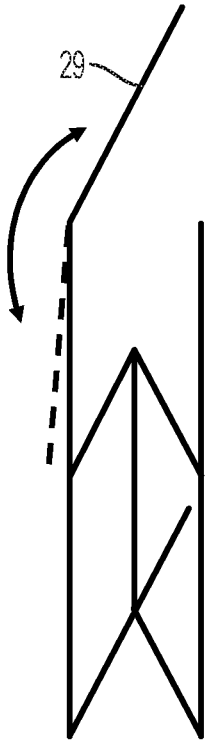
FIG. 15B is a side view of the foldable storage compartment shown in FIG. 15 being collapsed.
Figure 15C:
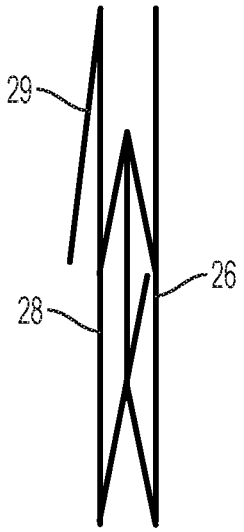
FIG. 15C is a side view of the foldable storage compartment shown in FIG. 15 in the collapsed position.
Figure 16:
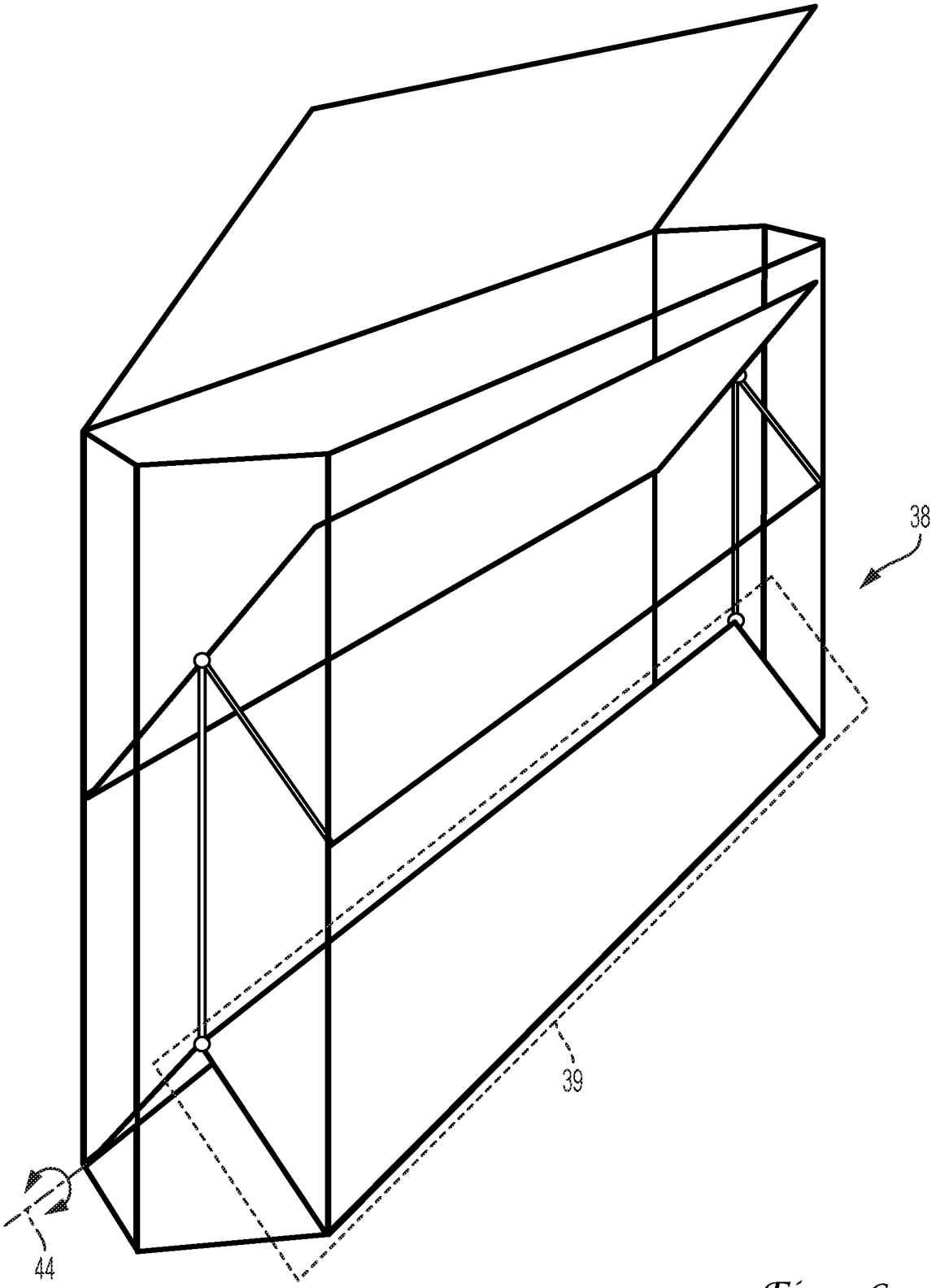
FIG. 16 is a perspective view of a first variant of the foldable storage compartment shown in FIG. 15.
Figure 17:
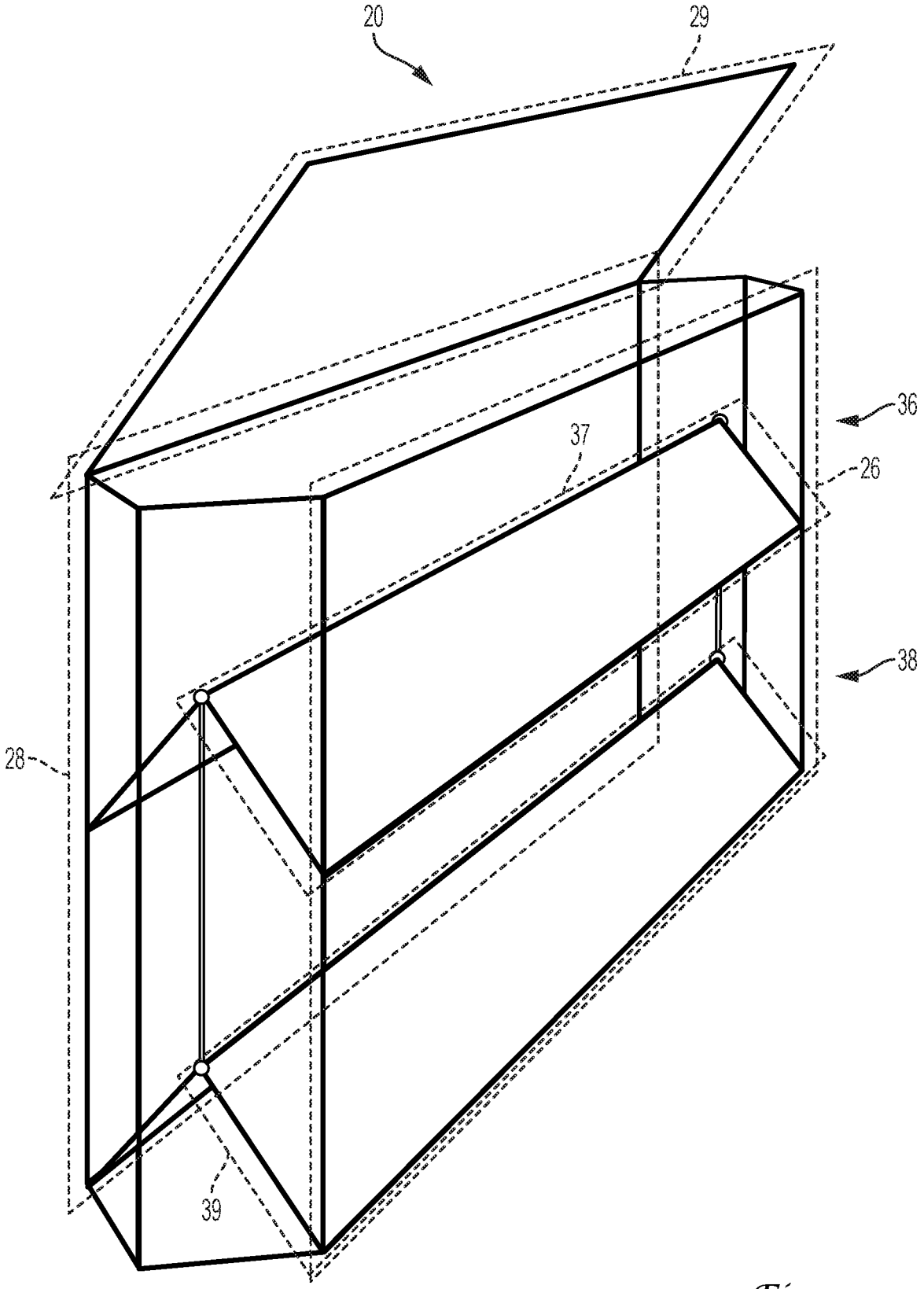
FIG. 17 is a perspective view of a fifth embodiment of the foldable storage compartment.
Figure 17A:
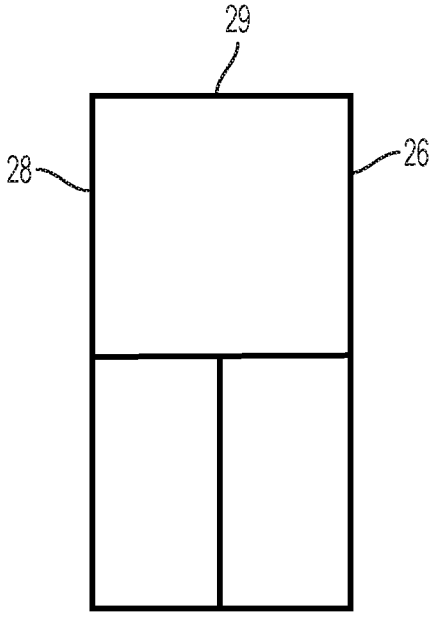
FIG. 17A is a side view of the foldable storage compartment shown in FIG. 17 in the erect position.
Figure 17B:
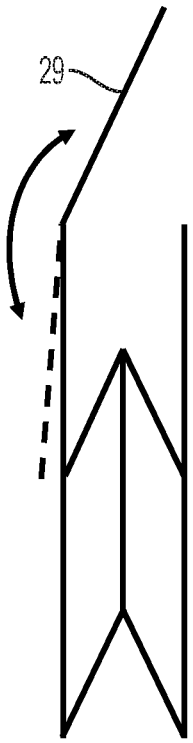
FIG. 17B is a side view of the foldable storage compartment shown in FIG. 17 being collapsed.
Figure 17C:
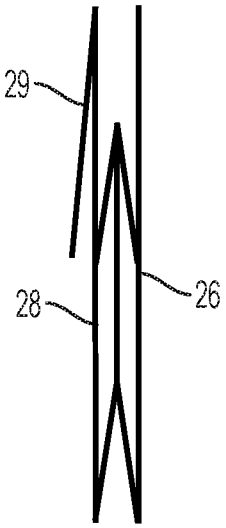
FIG. 17C is a side view of the foldable storage compartment shown in the collapsed position.

Referring now to FIGS. 15-17C, the foldable storage compartment 18 may have the same structure as that of the foldable storage compartments 10-24 except that the front panel linkage 48 may be accomplished by utilizing one half of one or both of the shelf 36, 38. FIG. 15 illustrates one half 37 of the shelf 36 that replaces the front panel linkage 48*b*. The one half 37 of the shelf 36 may pivot about the front panel 26 at the same vertical height as the rotational axis 42 (see FIG. 1). FIGS. 15A-15C illustrate the process of erecting and collapsing the foldable storage compartment 18. FIG. 16 illustrates one half 39 of the second shelf 38 that replaces the front panel linkage 48*a*. The one half 39 of the second shelf 38 may pivot about the front panel 26 at the same vertical height as the rotational axis 44 (see FIG. 1). FIG. 17 illustrates one halves 37, 38 of the first and second shelves 36, 38 that both function and replace the front panel linkages 48*a*, 48*b*. FIGS. 17A-17C illustrate the process of collapsing and erecting the foldable storage compartment 20.

Figure 18:
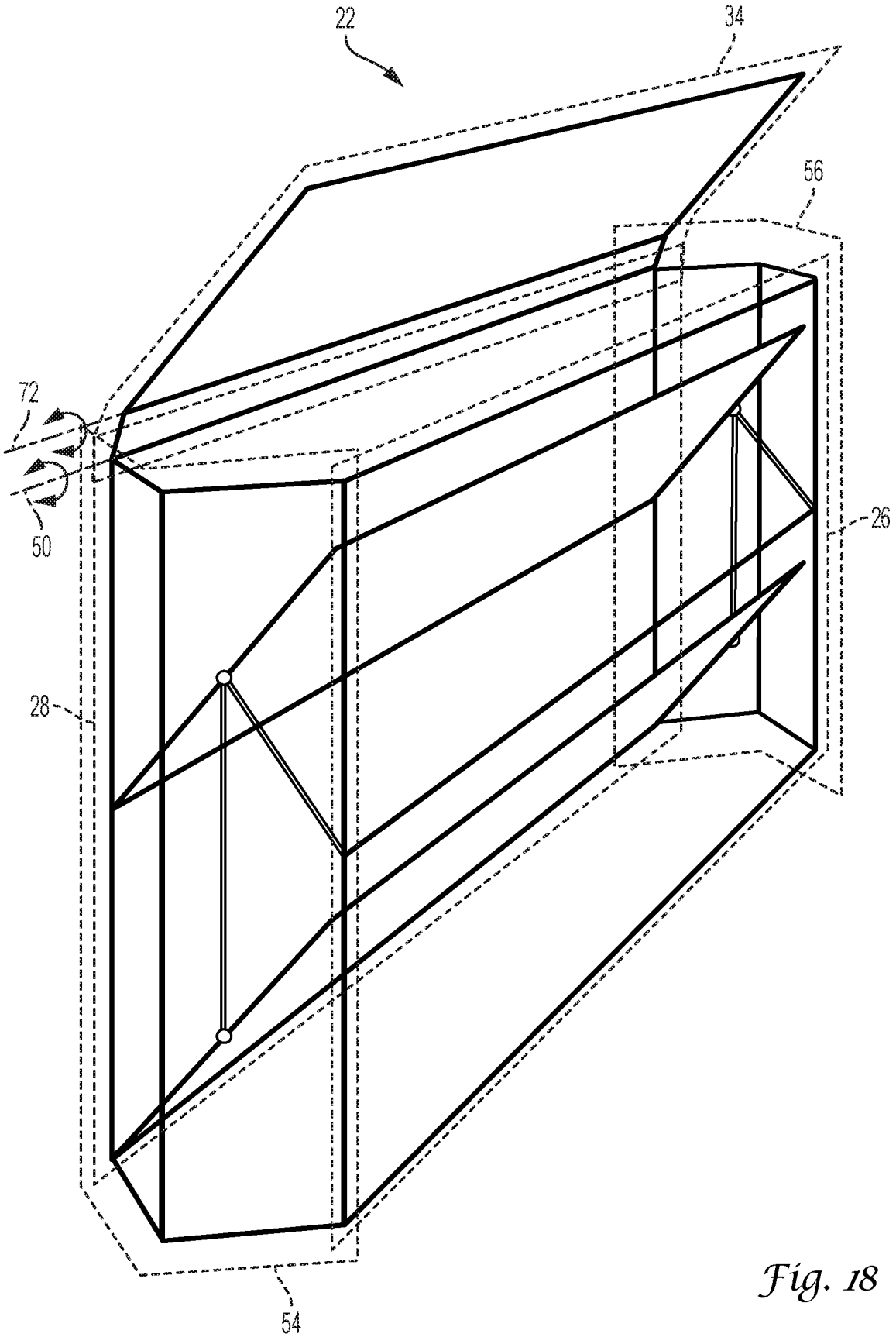
FIG. 18 is a sixth embodiment of the foldable storage compartment.
Figures 18A, 18B, 18C, 18D:
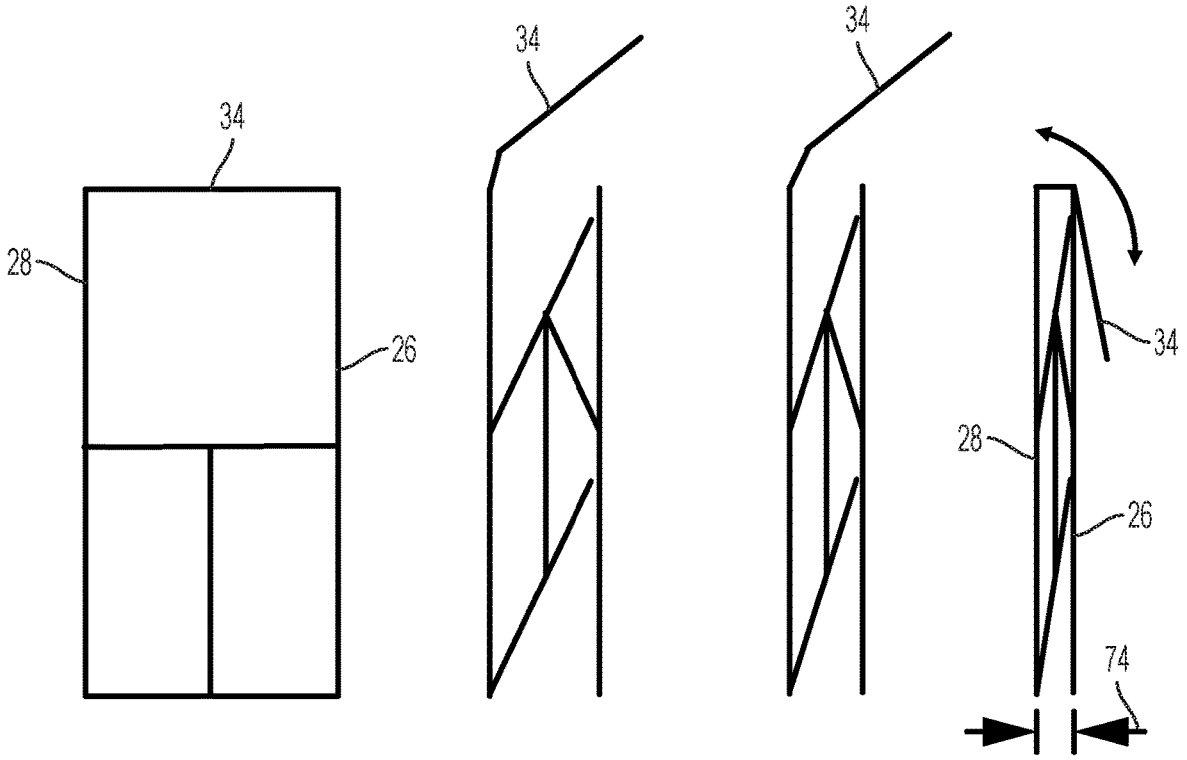
FIG. 18A is a side view of the foldable storage compartment shown FIG. 18 in the erect position.
FIG. 18B is a side view of the foldable storage compartment shown in FIG. 18 being collapsed.
FIG. 18C is a side view of the foldable storage compartment shown in FIG. 17 being further collapsed.
FIG. 18D is a side view of the foldable storage compartment shown in FIG. 17 in the collapsed position.
Figure 19:
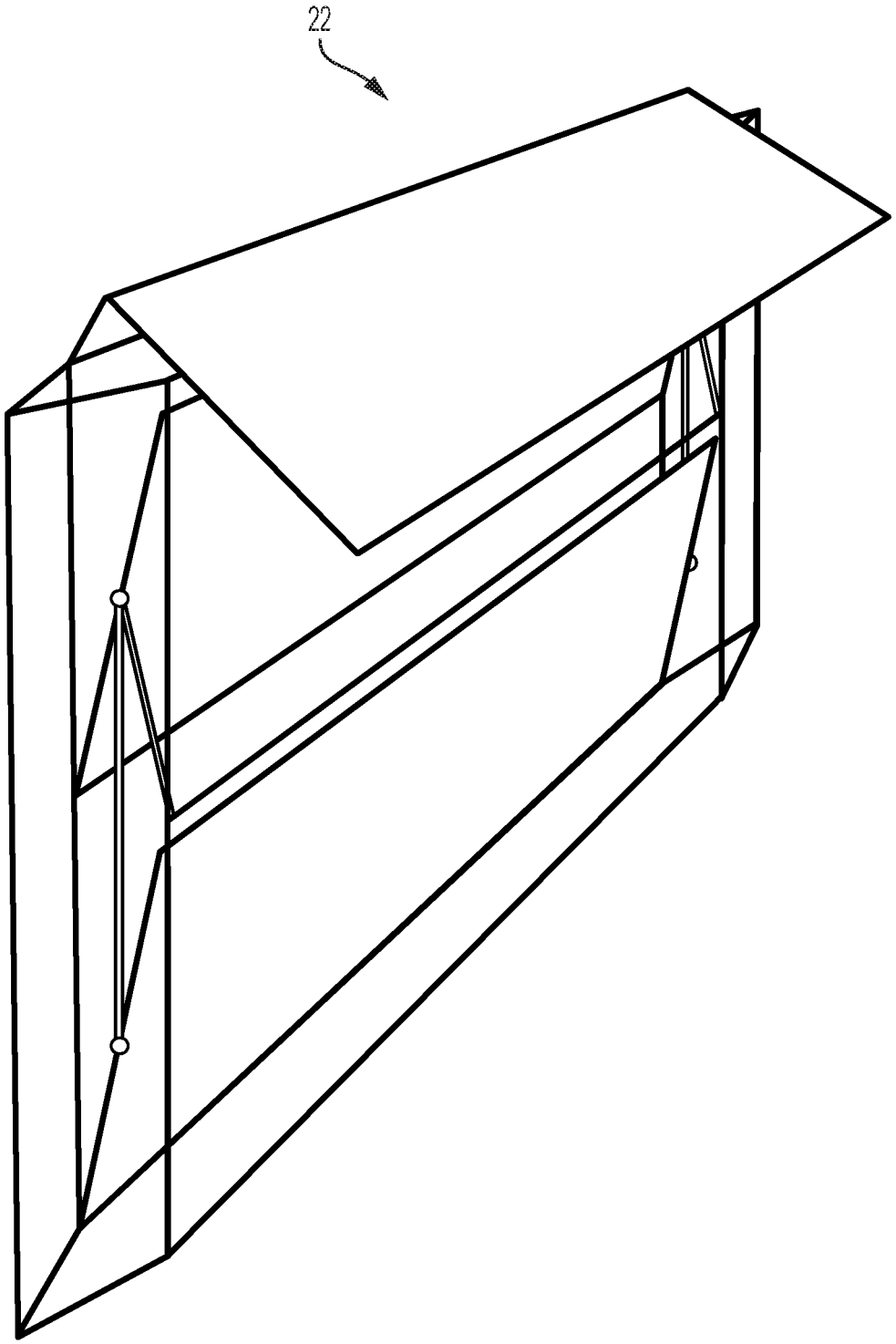
FIG. 19 is a perspective view of the foldable storage compartment shown in FIG. 17 being collapsed.

Referring now to FIGS. 18-19, the foldable storage compartment 22 may have the same or similar structure as that of the foldable storage compartments 10-24 except that the lid 34 may be pivotable to a front side of the foldable storage compartment. As shown in FIG. 18, the lid 34 is foldable at pivot axis 72. A distance between pivot axis 50 and the pivot axis 72 may be greater than a thickness 74 of the shelves 36, 38 and the front and rear panels 26, 28, as shown in FIG. 18D. FIGS. 18A-18D illustrate the foldable storage compartment 22 being collapsed and erected. FIG. 19 illustrates a perspective view of the foldable storage compartment 22 in a state between that shown in FIG. 18C and FIG. 18D.

Referring now to FIG. 20, the foldable storage compartment 24 is shown without a lid 29, 30, 32, 34. The foldable storage compartment 24 may have the same or similar structure as that in relation to foldable storage compartments 10, 12, 16, 18, 22, 24 discussed herein. Additionally, the foldable storage compartment 24 illustrates that the in lieu of or in addition to a front panel linkage 48 or 49, the shelves 36, 38 may be connected to the front panel 26 by way of a front plate 51. The front plate 51 may extend a same width as the shelves 36, 38 or be smaller in width compared to the shelves 36, 38. The front plate 51 may be used for one or more of the shelves 36, 38.

Figure 29:
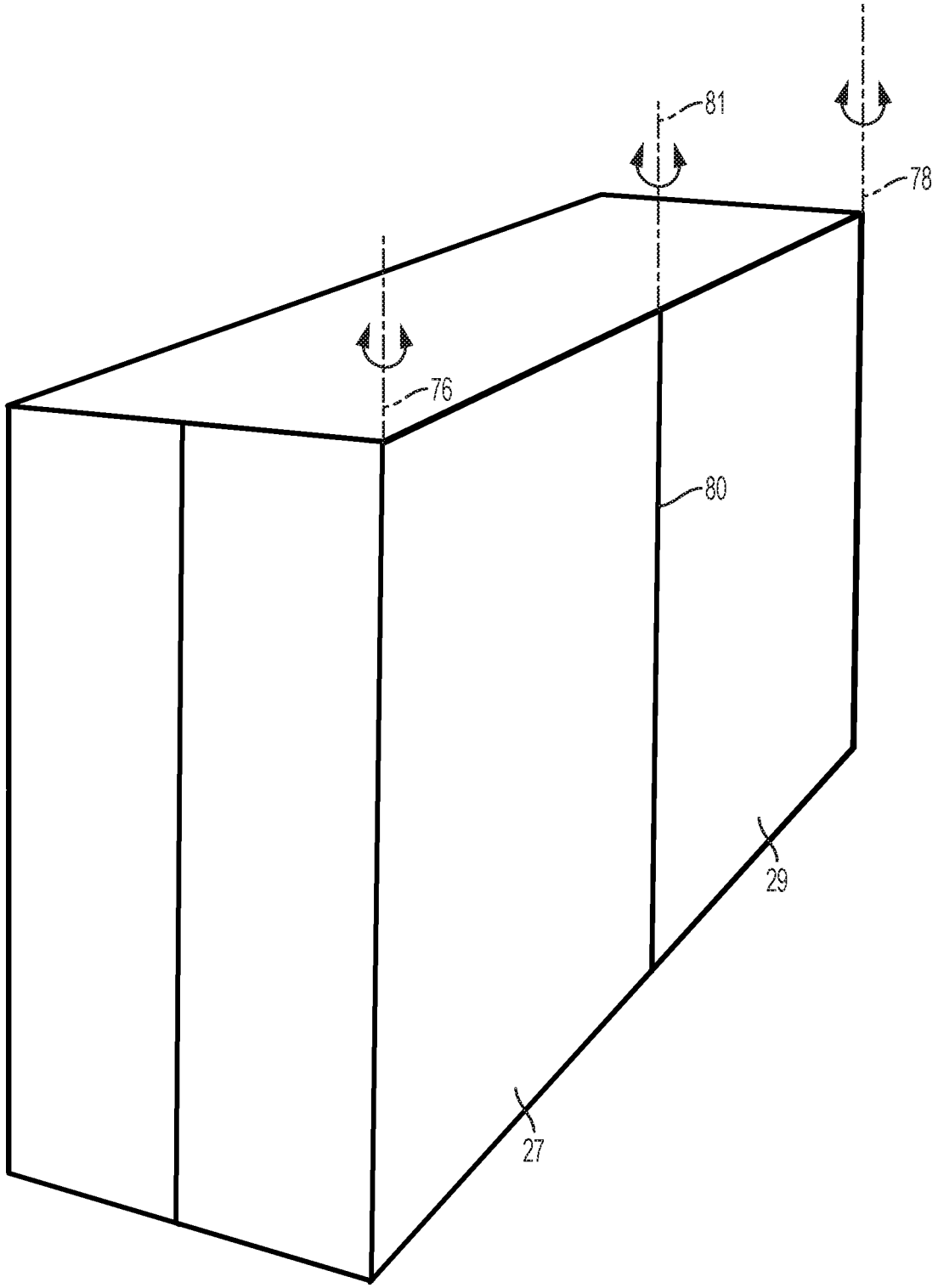
FIG. 29 illustrates a foldable storage compartment with doors.
Figure 30:
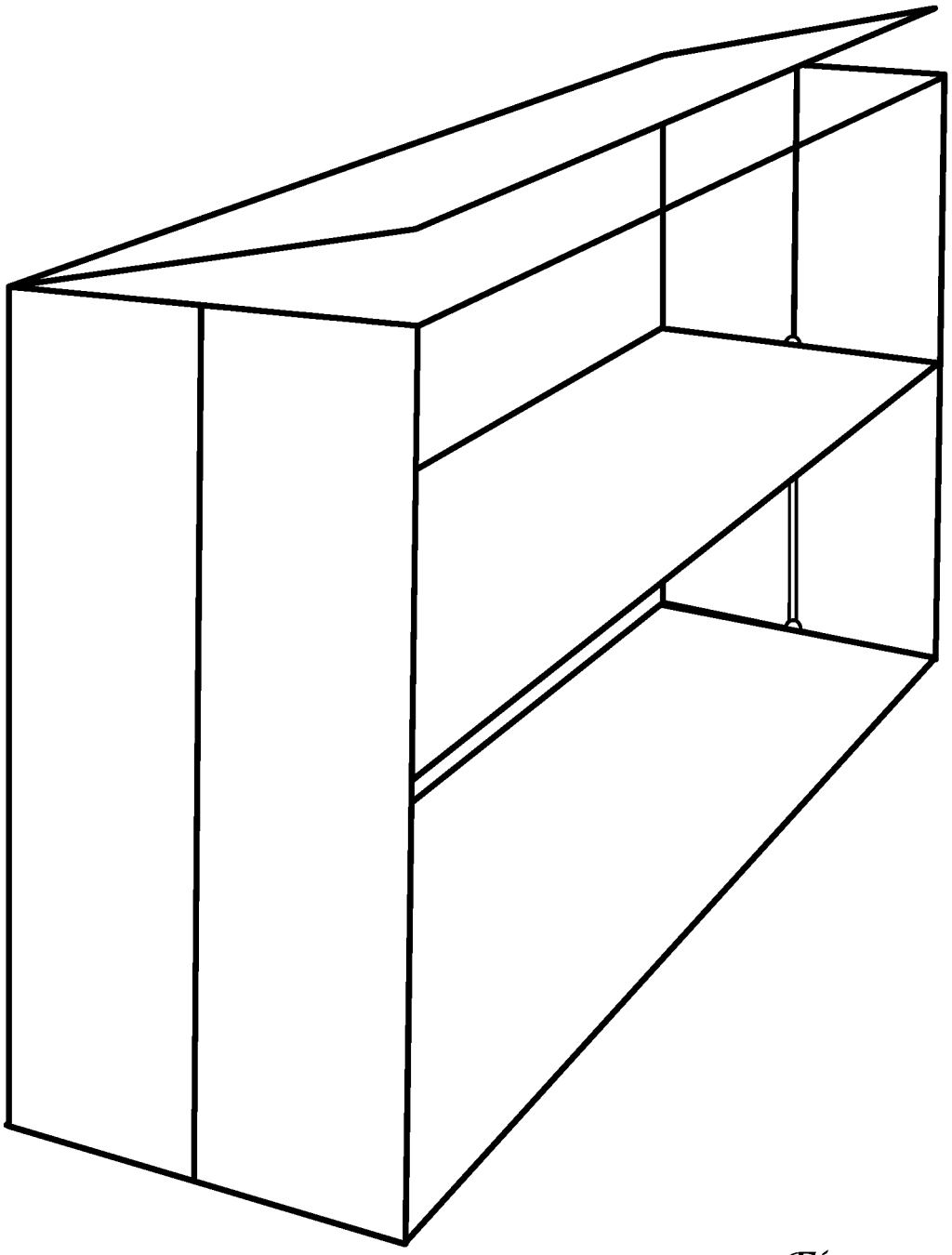
FIG. 30 illustrates a foldable storage compartment without doors and a rotatable lid.

Referring now to FIGS. 29 and 30, the foldable storage compartments 10, 12, 16, 18, 22, 24 may have optional doors 27, 29 that open about pivot axes 76, 78 and open up at a middle 80 to access the shelves 36, 38. Alternatively, the foldable storage compartment 10, 12, 14, 16, 18, 22, 24 may not have doors and allow free access to the shelves 36, 38. This is shown in FIG. 30.

Figure 21:
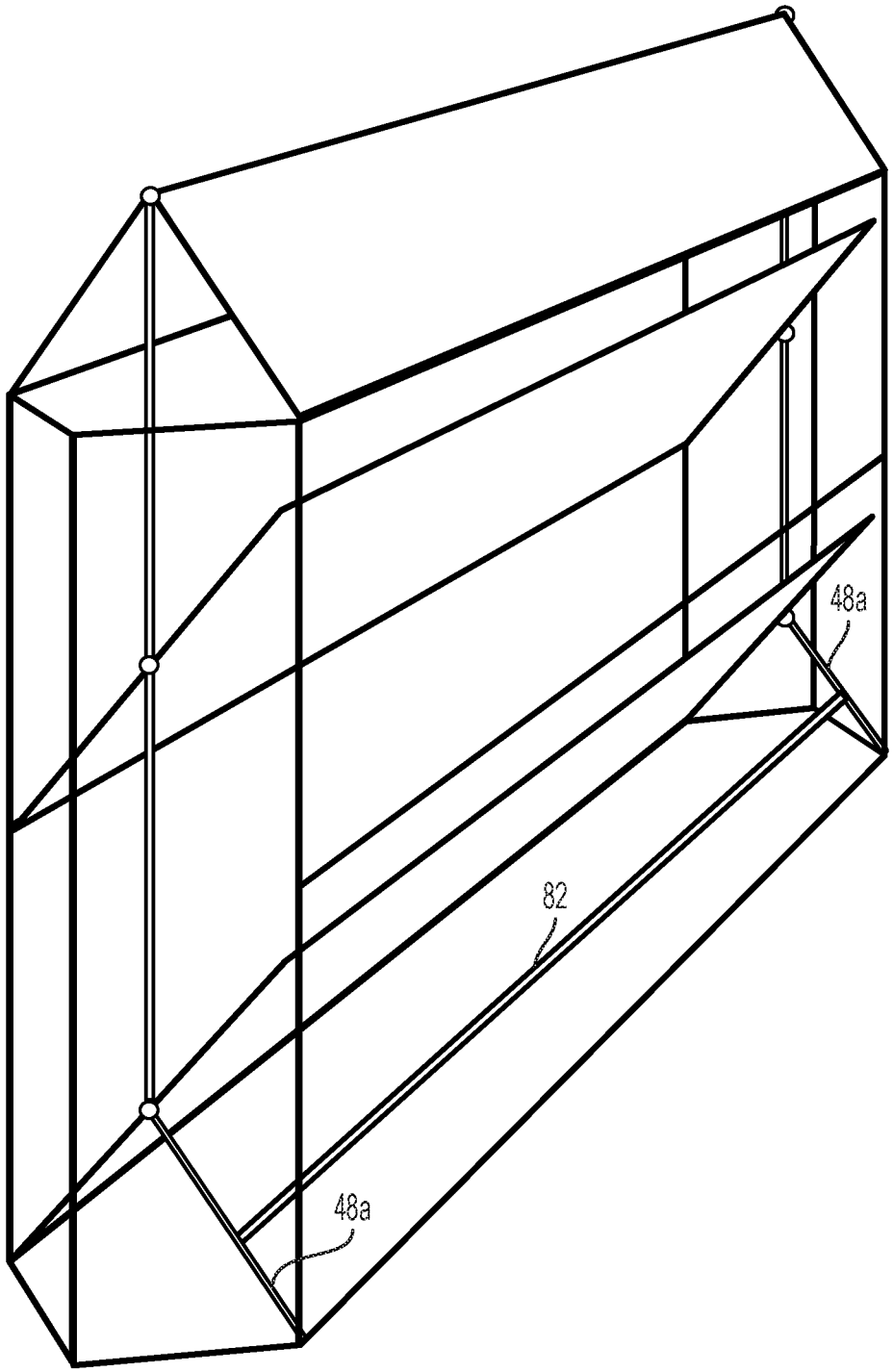
FIG. 21 illustrates a foldable storage compartment with a stabilizing bar between front panel linkages.

Referring now to FIG. 21, the foldable storage compartments 10, 12, 16, 18, 22, 24 may have a stabilizing bar 82 between the front panel linkages 48, 48*a*, 48*b*. The stabilizing bar 82 is shown as being secured or fixedly attached to the front panel linkages 48*a*. The stabilizing bar 82 reduces swaying of the foldable storage compartment and is especially helpful when the foldable storage compartment 10-24 is sized and configured to be very large. There may also be multiple stabilizing bars 82 on one or more pairs of front panel linkages 48*a*-*n*.

Figure 22:
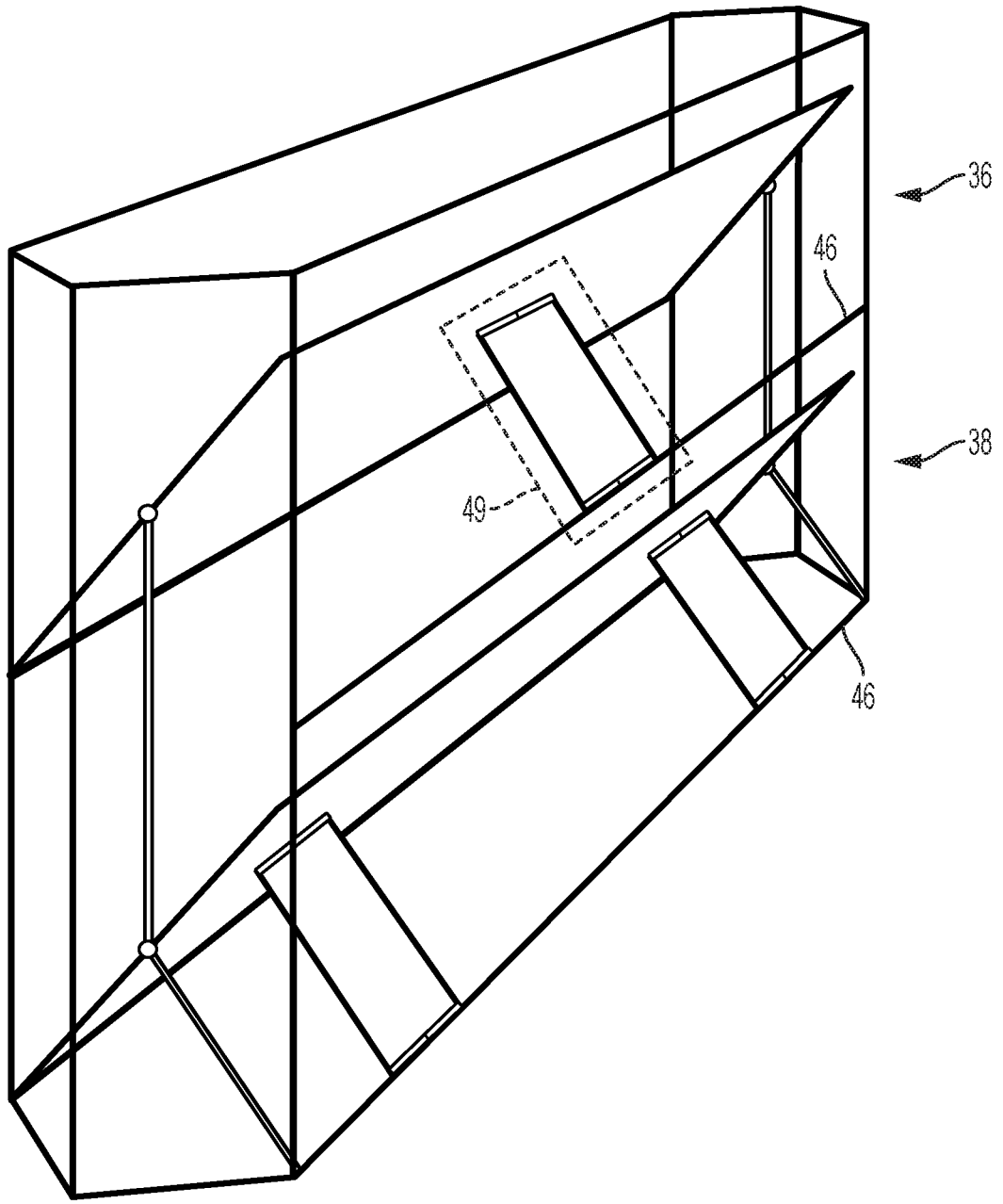
FIG. 22 illustrates a foldable storage compartment with reinforcing front panel linkages.

Referring now to FIG. 22, the foldable storage compartment 10, 12, 16, 18, 22, 24 may have reinforcing front panel linkages 49. The reinforcing front panel linkages 49 may be rotatably attached to bar 46 and the underside of the shelves 36, 38, and more preferably at a midpoint on the underside surfaces of the shelves 36, 38.

Figure 27:
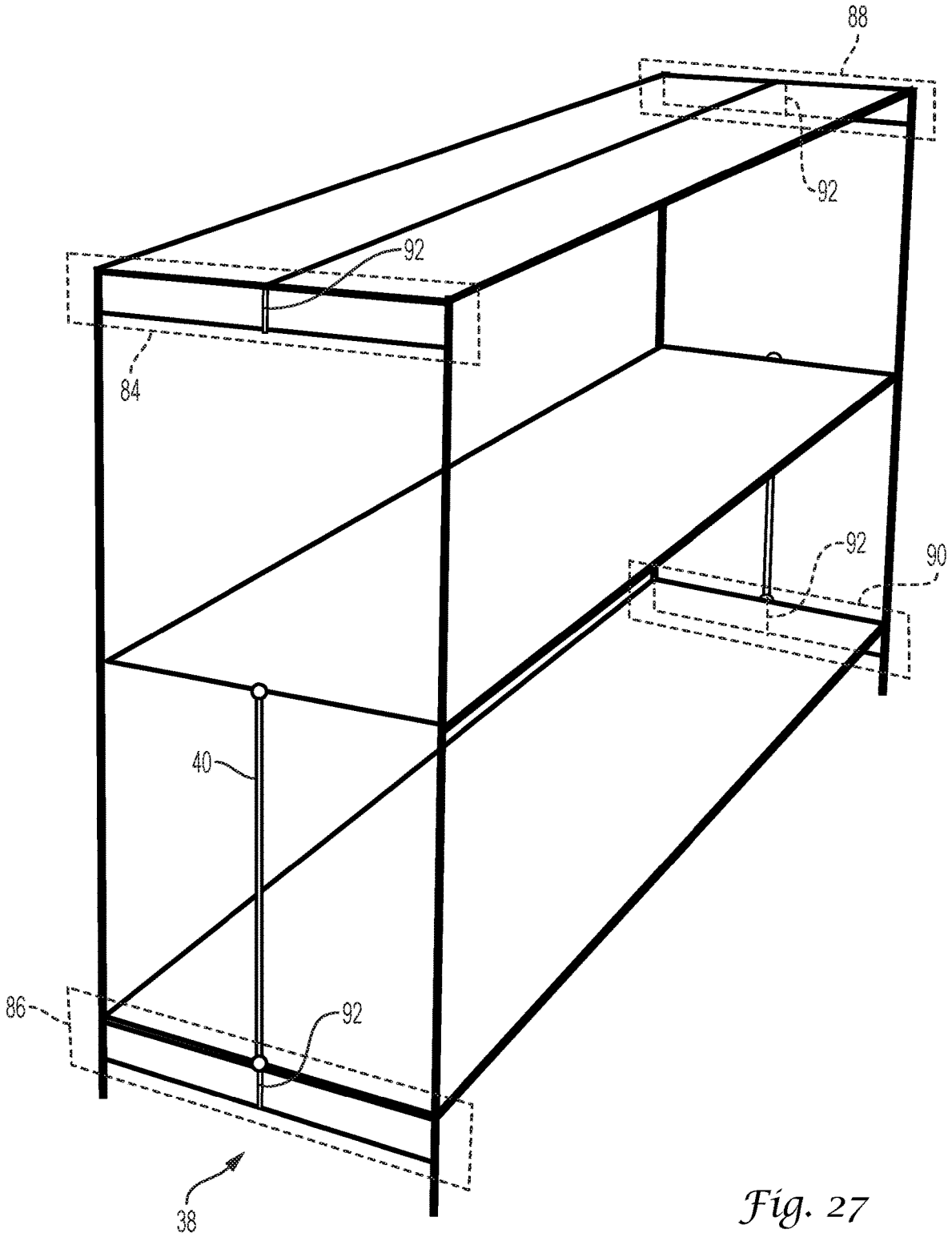
FIG. 27 illustrates a foldable storage compartment having inwardly foldable side strips.
Figure 28:
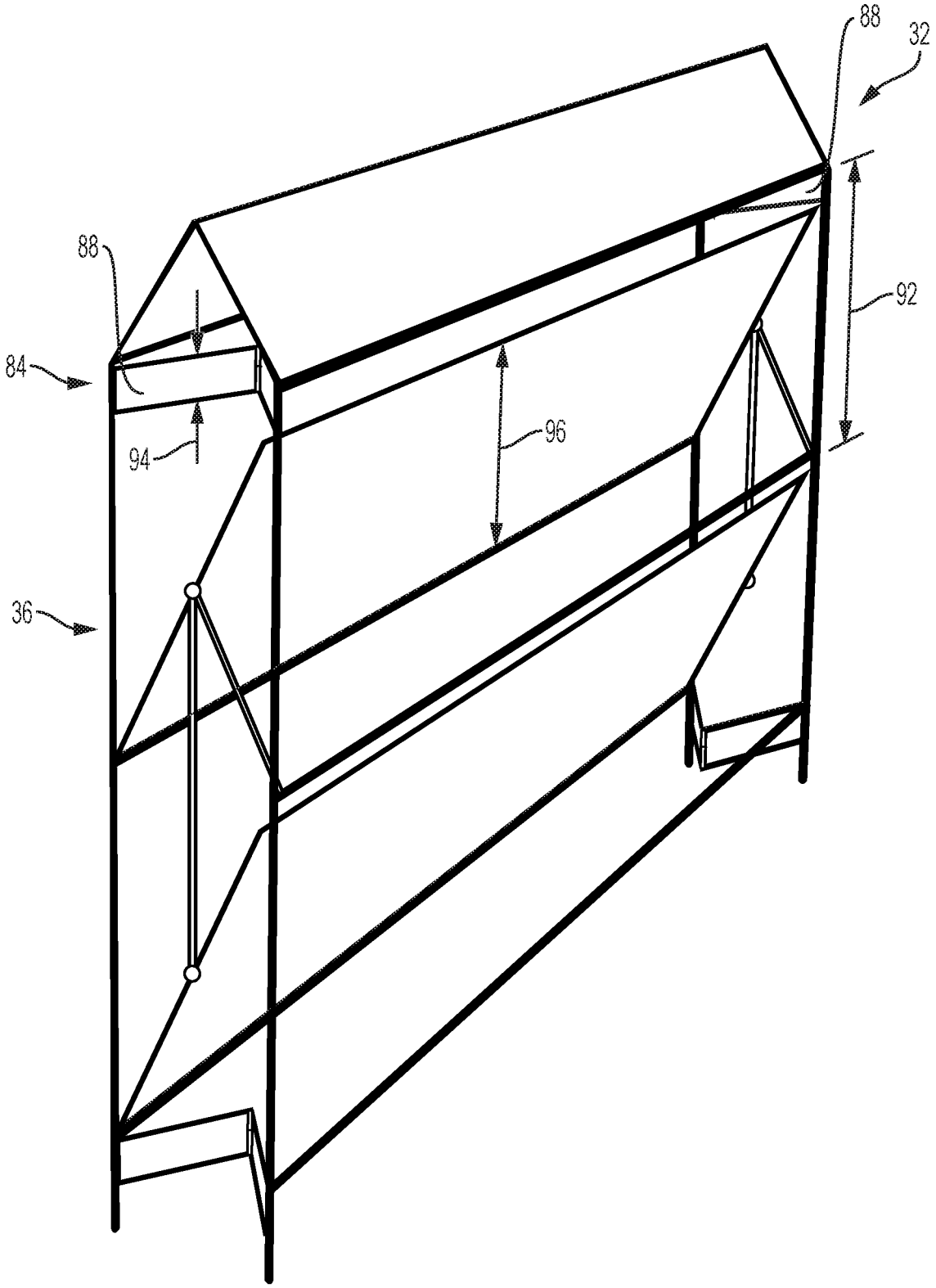
FIG. 28 illustrates the foldable storage compartment shown in FIG. 29 being collapsed.

Referring now to FIGS. 27-28, reinforcing side strips 84, 86, 88, 90 are shown. The reinforcing side strips 84, 86, 88, 90 fold inward as opposed to outward as shown in FIGS. 1-26, 29 and 30. Reinforcing side strips 84-90 preferably have a midpoint about which the reinforcing side strips 84-90 collapse. Additionally, the midpoint preferably collapses only inward. However, it is also contemplated that the reinforcing side strips 84-90 may collapse outward or bidirectionally (i.e. inward and/or outward). The reinforcing side strips 84-90 may be disposed below the lid 32 and below the first shelf 38. Preferably, the first and second reinforcing side strips 84, 86, 88, 90 are positioned vertically where no vertical linkage 40 is located so that the reinforcing side strips 84-90 may be folded inward as the foldable storage compartment 10-24 is traversed to the collapsed position. Additionally, a distance 92 between the lid and the second shelf 38 when the foldable storage compartment is in the erected position is greater than a height 94 of the reinforcing side strips 84, 88 plus a depth 96 of the first shelf 36.

Figure 31:
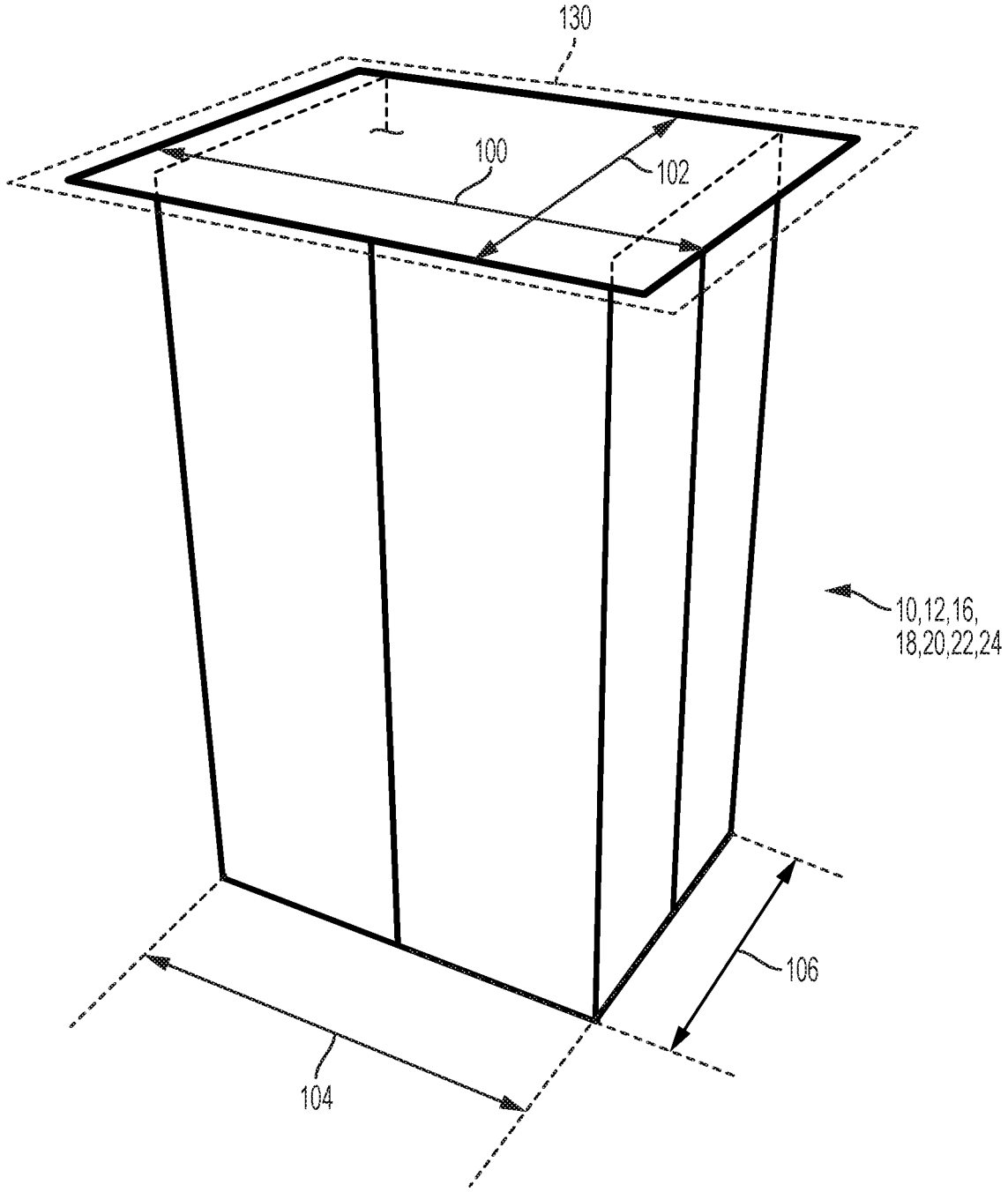
FIG. 31 illustrates a foldable storage compartment with a lid and doors.
Figure 32:
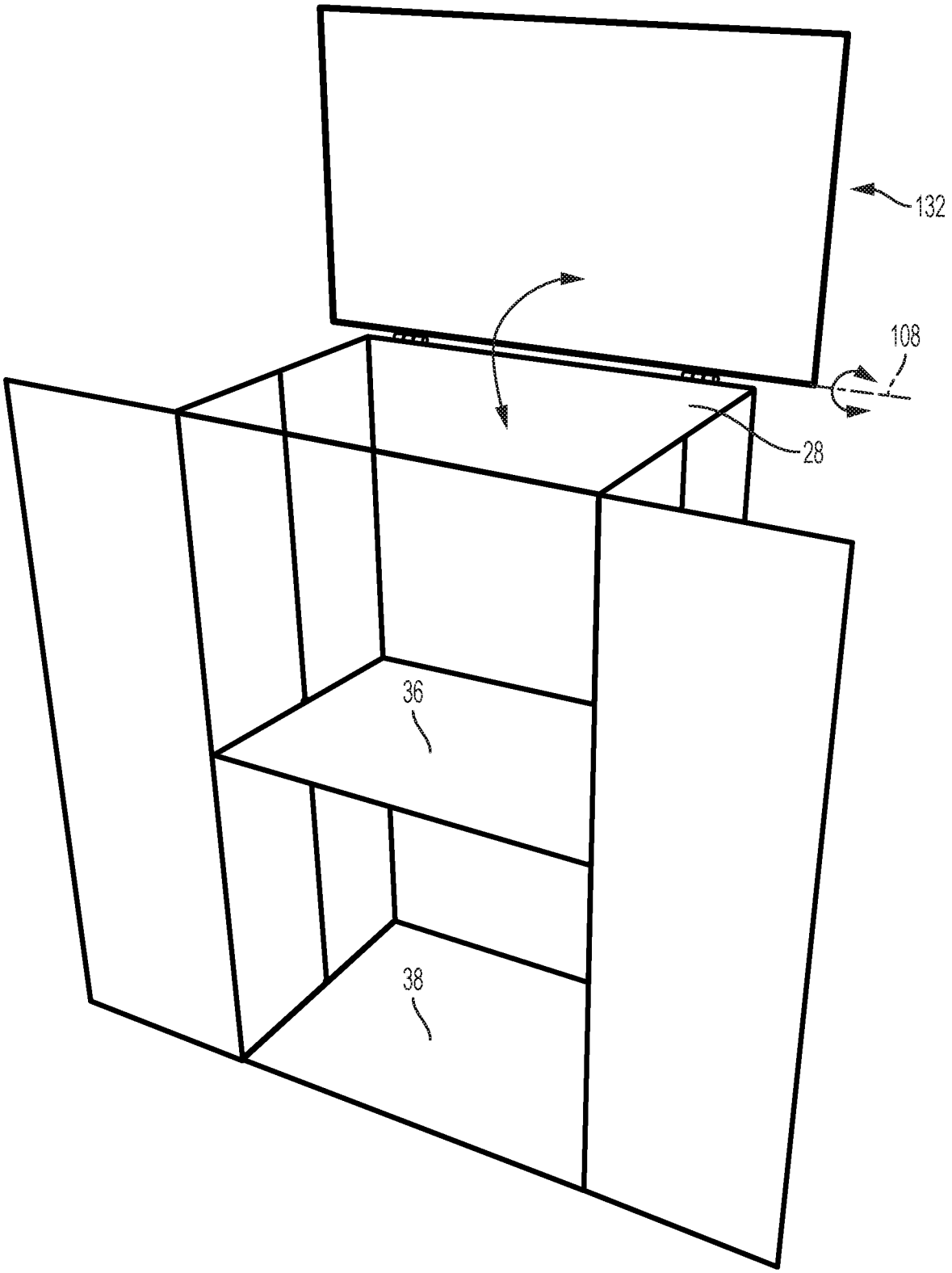
FIG. 32 illustrates the lid and doors of the foldable storage compartment shown in FIG. 31 being lifted up and opened.
Figure 33:
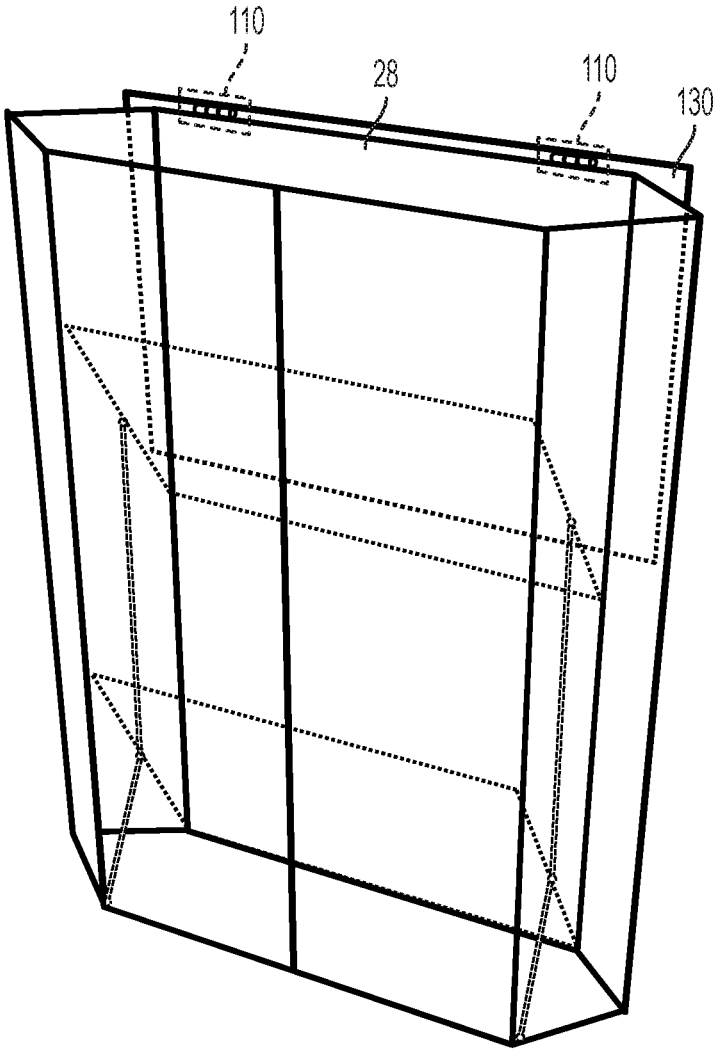
FIG. 33 illustrates the foldable storage compartment shown in FIG. 31 in a collapsed position.
Figure 34:
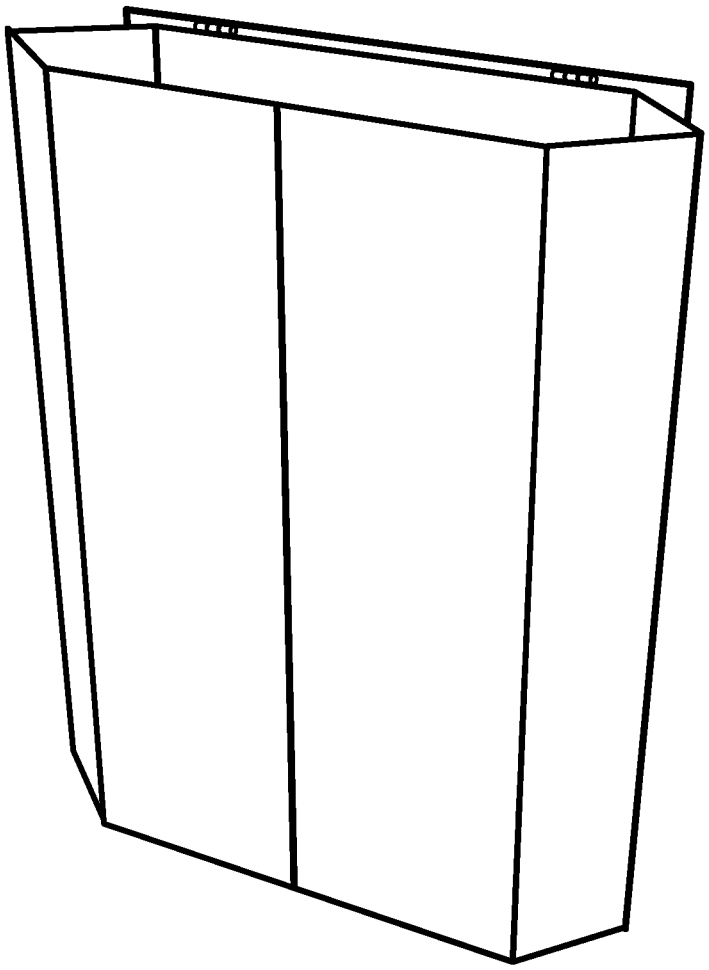
FIG. 34 illustrates the foldable storage compartment shown in FIG. 33 without showing internals of the foldable storage compartment.
Figure 35:
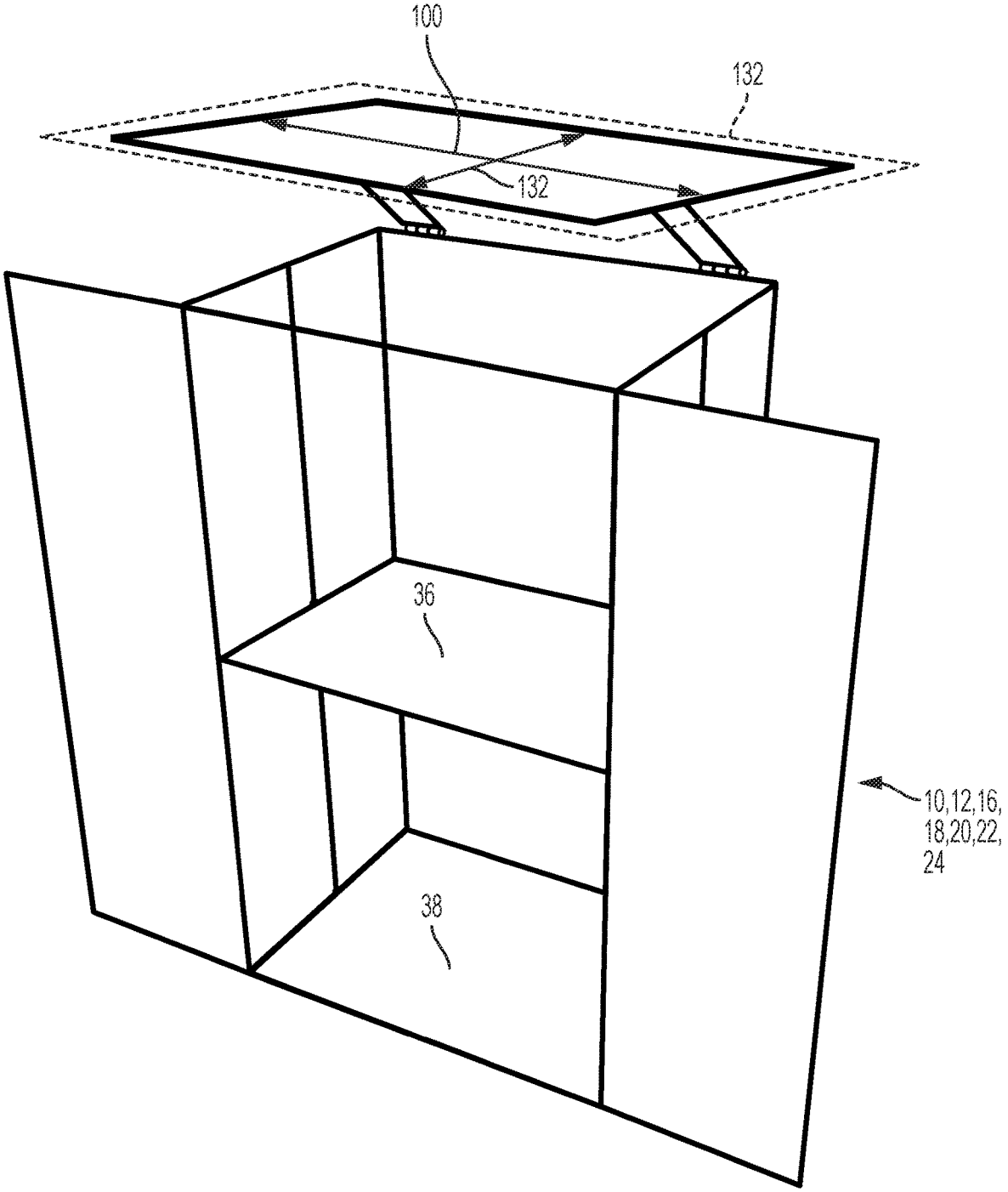
FIG. 35 illustrates a variant of a mechanism for rotating the lid between erected and collapsed positions.
Figure 36:
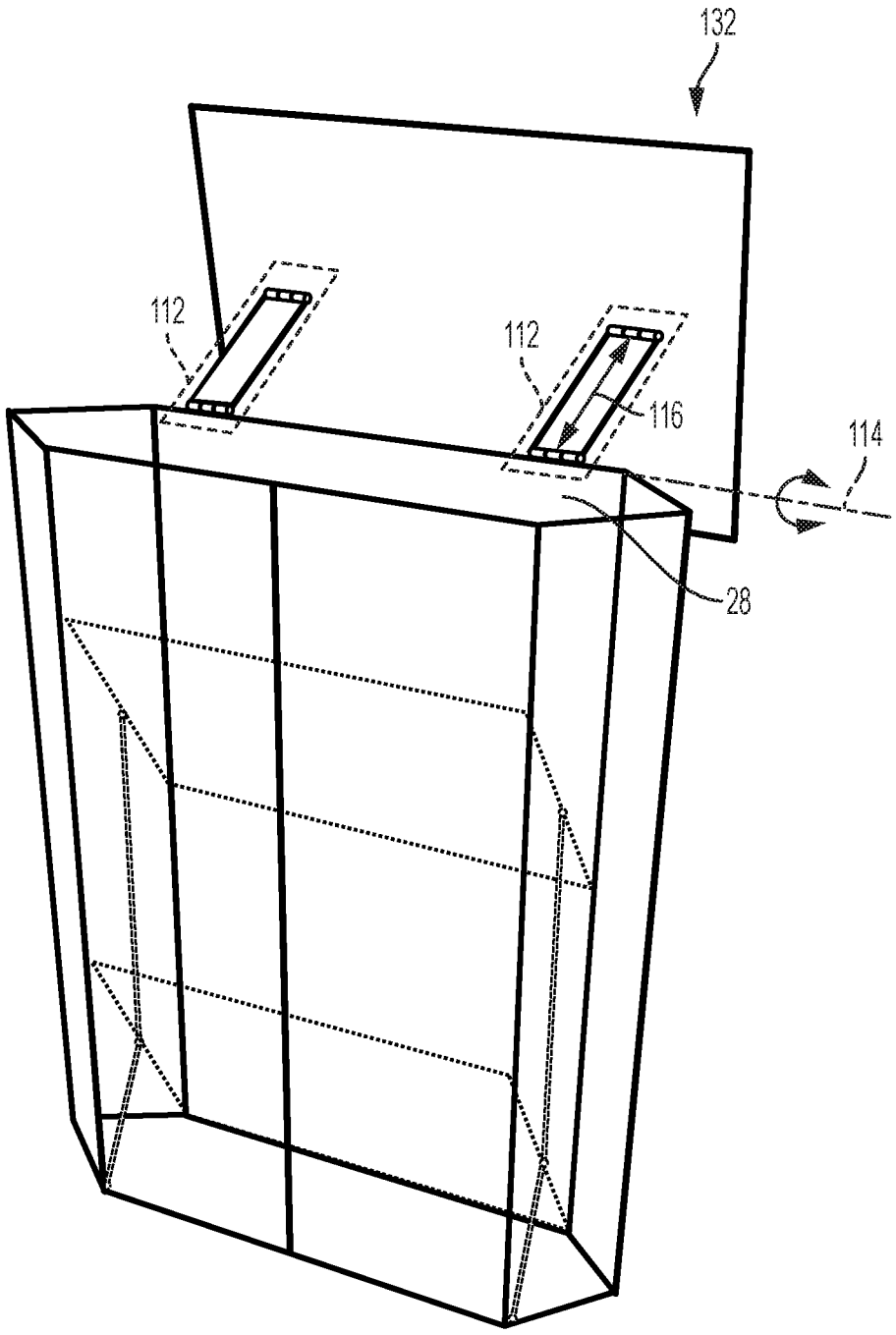
FIG. 36 illustrates the second variant of the mechanism for rotating the lid as the lid is being traversed to the collapsed position.

Referring now to FIGS. 31-34 and FIGS. 35-36, two different types of tops 130, 132 are shown. The tops 130, 132 have a length 100 and width 102 that are greater than the length 104 and width 106 of the foldable storage compartment. However, it is also contemplated that the tops 130, 132 may have a length and width 100, 102 that is coextensive with the length and width 104, 106 of the foldable storage compartment. Tops 130, 132 may be incorporated into any one of the foldable storage compartments 10-24. The following description describes how tops 130, 132 may be traversed between the collapsed position and the erected position. The erected position is shown in FIG. 31. The top 130, 132 may have an upper surface that is generally parallel with the shelves 36, 38 when the foldable storage compartment 10-24 and the tops 130, 132 are in the erected position. In the collapsed position, the tops 130, 132 are folded behind the collapsed foldable storage compartment 10-24 as shown in FIGS. 33 and 34. Although the collapsed and erected positions for the top 132 are not shown, this is merely for the purposes of clarity. The top 132 can be traversed down so that the top 132 rests on the front and rear panels 26, 28 or other supports of the foldable storage compartment so that the upper surface of the top 132 is parallel to the shelves 36, 38 when the foldable storage compartment and the top 132 are in the erected position. Moreover, the top 132 may be deployed to the collapsed position behind the collapsed foldable storage compartment as generally indicated in FIG. 36.

Referring back to FIGS. 31-34, the top may be pivotally rotated about the rear panel 28. The pivot axis 108 about which the top 132 rotates may be coaxial or closely aligned to pivot axis 50 shown in FIG. 1. By closely aligned, this means that the pivot axis 108 may be less than 4 inches away from the pivot axis 50 and is preferably less than 1 inch away from the pivot axis 50. The top 132 may be rotated fully to the backside of the rear panel 28 as shown in FIG. 33. The shelves 36, 38 are shown as being in the collapsed position when the top 32 is in the collapsed position, but this is not required. The top 130 may be pivoted from the erected position shown in FIG. 31 to the collapsed position approximately 270° shown in FIG. 33 even if the shelves are not collapsed. The top 130 may be pivotally attached to the rear panel 28 with hinges 110.

In FIGS. 35 and 36, the top 132 may be pivotally attached to the rear panel 28 with the pivot hinge 112. The pivot hinges 112 may be rotatably attached to the top 130 and the rear panel 28. The rotational axis about which the pivot hinge 112 rotates with respect to the rear panel 28 may be identified as rotational axis 114. The pivot axis 114 about which the pivot hinges 112 rotate with respect to the rear panel 28 may be coaxial or closely aligned to pivot axis 50 shown in FIG. 1. By closely aligned, this means that the pivot axis 114 may be less than 4 inches away from the pivot axis 50 and is preferably less than 1 inch away from the pivot axis 50. The top 132 may be rotated fully to the backside of the rear panel 28 either when the shelves 36, 38 are disposed in the collapsed position or the erected position. The pivot hinges 112 may also be rotatably attached to the top 132. Preferably, the location of such attachment positions the top 132 on the foldable storage compartment 10-24 when the foldable storage compartment 10-24 is in the erect position. The length 116 of the pivot hinge 112 and the position of the attachment between the pivot hinges 112 and the top 132 are sized and configured so that the top 132 is aligned to the foldable storage compartment 10-24 when the full storage compartment 10-24 is in the erected position.

It is contemplated that one or more wheels may be attached to the bottom of the storage compartment 10-24. The wheels may be attached to the front and rear panels or the side panels. One wheel may be attached to each corner of the storage compartment 10-24 so that the compartment 10-24 is supported by the four wheels when the storage compartment 10-24 is in the erect position. Also, when the storage compartment is collapsed, the wheels may help to support the compartment 10-24 in the collapsed position but also to store the collapsed storage compartment 10-24 vertically to take up less floor space. Additionally, the wheels may be used to assist in traversing the compartment 10-24 from the collapsed position to the erect position for storage compartments 10-24 that are heavy or carpeted areas which may not allow the storage compartment 10-24 to slide on the carpet as well as more slippery surfaces such as concrete.

The shelves are shown as being flat. However, it is also contemplated that the shelves may be formed to hold bottles of wine or other food or containers. By way of example and not limitation, the storage compartment may be designed to hold food products (e.g., vegetables, meat, etc.). The storage compartment 10-24 may be fabricated from material that can be heated in an oven. The storage compartment 10-24 can be fabricated to be waterproof and heat insulated.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A foldable storage compartment for storing objects on a shelf when the storage compartment is in an erect position, the foldable storage compartment comprising:

a first frame and a second frame;

a first shelf defining a first side edge and an opposed second side edge to the first side edge and a third front edge and an opposed fourth rear edge to the third front edge, the first shelf defining a horizontal axis by a direction from the first side edge to the opposed second side edge, the first shelf being foldable about the horizontal axis, the first shelf being rigid in a direction from the first side edge to the opposed second side edge, the first shelf being pivotable adjacent the fourth rear edge and the fourth rear edge being closer to the second frame than the first frame;

a collapsible first side frame disposed adjacent to the first side edge, the collapsible first side frame attached to the first frame and the second frame, the collapsible first side frame being rigid vertically and being collapsible about a first vertical axis;

a collapsible second side frame disposed adjacent to the second side edge, the collapsible second side frame attached to the first frame and the second frame, the collapsible second side frame being rigid vertically and being collapsible about a second vertical axis;

wherein the horizontal axis about which the first shelf is foldable is aligned between the third front edge and the opposed fourth rear edge, the third and fourth edges of the first shelf being pivotally attached to front and rear sides of the collapsible first and second side frames.

2. The foldable storage compartment of claim 1 further comprising:

a second shelf disposed below or above the first shelf, the second shelf disposed between the first and second side frames, the second shelf defining a first side edge and an opposed second side edge to the first side edge and a third front edge and an opposed fourth rear edge to the third front edge, the second shelf being rigid in a direction from the first side edge to the opposed second side edge, the second shelf being pivotable about the fourth rear edge of the second shelf and the fourth rear edge of the second shelf being aligned to the second frame;

wherein all vertical linkages are pivotally attached to the first and second between the third front edges and the opposed fourth rear edges of the first and second shelves.

3. The foldable storage compartment of claim 1 wherein at least one of the first frame and the second frame is defined by a plurality of elongate members.

4. The foldable storage compartment of claim 1 wherein the first side frame and the front and second frames is share a common elongate edge or member so that the first side frame pivots with respect to the front and second frames about the common elongate edge or member.

5. The foldable storage compartment of claim 1 wherein the second side frame and the front and second frames is share a common elongate edge or member so that the second side frame pivots with respect to the front and second frames about the common elongate edge or member.

6. The foldable storage compartment of claim 1 wherein at least one of the first frame and second frame has an opening to access objects placed on the first shelf.

7. The foldable storage compartment of claim 1 further comprising a top cover pivotable about the second frame, the top cover being pivotable to be parallel to the second frame, the top cover disposed adjacent to a rear side of the second frame when the foldable storage compartment is in a collapsed position.

8. The foldable storage compartment of claim 1 further comprising a top cover pivotable about the second frame, the top cover being pivotable to be parallel to the second frame, the top cover disposed adjacent to a front side of the second frame when the foldable storage compartment is in a collapsed position.

9. A method for collapsing and erecting a foldable storage compartment, the method comprising the steps of:

providing a foldable storage compartment, the foldable storage compartment comprising:

a first frame and a second frame;

a first shelf defining a first side edge and an opposed second side edge to the first side edge and a third front edge and an opposed fourth rear edge to the third front edge, the first shelf defining a horizontal axis by a direction from the first side edge to the opposed second side edge, the first shelf being foldable about the horizontal axis, the first shelf being rigid in a direction from the first side edge to the opposed second side edge, the first shelf being pivotable adjacent about the fourth rear edge and the fourth rear edge being closer to the second frame than the first frame;

a collapsible first side frame disposed adjacent to the first side edge, the collapsible first side frame attached to the first frame and the second frame, the collapsible first side frame being rigid vertically and being collapsible about a first vertical axis;

a collapsible second side frame disposed adjacent to the second side edge, the collapsible second side frame attached to the first frame and the second frame, the collapsible second side frame being rigid vertically and being collapsible about a second vertical axis;

wherein the horizontal axis about which the first shelf is foldable is aligned between the third front edge and the opposed fourth rear edge, the third and fourth edges of the first shelf being pivotally attached to front and rear sides of the collapsible first and second side frames;

pulling the front and second frames further away from each other when the foldable storage compartment is in collapsed position to traverse the foldable storage compartment to an erect position and the first shelf from a vertical position to a horizontal position; and lifting the first shelf upwards traverses the front and second frames closer to each other and the first shelf from the horizontal position to the vertical position.

10. The method of claim 9 further comprising the step of pushing the front and second frames closer to each other when the foldable storage compartment is in the erect position to traverse the foldable storage compartment to the collapsed position.

11. The method of claim 9 further comprising the step of lifting a lid to traverse the front and second frames closer to each other and traverse the foldable storage compartment to the collapsed position from the erect position.

12. A foldable storage compartment for storing objects on a shelf when the storage compartment is in an erect position, the foldable storage compartment comprising:

a first frame and a second frame;

a first shelf defining a first side edge and an opposed second side edge to the first side edge and a third front edge and an opposed fourth rear edge to the third front edge, the first shelf defining a horizontal axis by a direction from the first side edge to the opposed second side edge, the first shelf being pivotable about the horizontal axis, the first shelf being rigid in a direction from the first side edge to the opposed second side edge, the first shelf being pivotable adjacent the fourth rear edge and the fourth rear edge closer to the second frame than the first frame;

a collapsible first side frame disposed adjacent to the first side edge, the collapsible first side frame attached to the first frame and the second frame, the collapsible first side frame being rigid vertically and being collapsible about a first vertical axis;

a collapsible second side frame disposed adjacent to the second side edge, the collapsible second side frame attached to the first frame and the second frame, the collapsible second side frame being rigid vertically and being collapsible about a second vertical axis;

wherein the horizontal axis about which the first shelf is foldable is adjacent to the fourth rear edge of the first shelf and the foldable storage compartment further comprises a linkage pivotally attached to the first shelf between the third front edge and the opposed fourth rear edge and the first frame.

13. A method for collapsing and erecting a foldable storage compartment, the method comprising the steps of:

providing a foldable storage compartment, the foldable storage compartment comprising:

a first frame and a second frame;

a first shelf defining a first side edge and an opposed second side edge to the first side edge and a third front edge and an opposed fourth rear edge to the third front edge, the first shelf defining a horizontal axis by a direction from the first side edge to the opposed second side edge, the first shelf being pivotable about the horizontal axis, the first shelf being rigid in a direction from the first side edge to the opposed second side edge, the first shelf being pivotable adjacent the fourth rear edge and the fourth rear edge being closer to the second frame than the first frame;

a collapsible first side frame disposed adjacent to the first side edge, the collapsible first side frame attached to the first frame and the second frame, the collapsible first side frame being rigid vertically and being collapsible about a first vertical axis;

a collapsible second side frame disposed adjacent to the second side edge, the collapsible second side frame attached to the first frame and the second frame, the collapsible second side frame being rigid vertically and being collapsible about a second vertical axis;

wherein the horizontal axis about which the first shelf is foldable is adjacent to the fourth rear edge of the first shelf and the foldable storage compartment further comprises a linkage pivotally attached to the first shelf between the third front edge and the opposed fourth rear edge and the first frame;

pulling the front and second frames further away from each other when the foldable storage compartment is in a collapsed position traverses the foldable storage compartment to an erect position and the first shelf from a vertical position to a horizontal position; and lifting the first shelf upwards traverses the front and second frames closer to each other and the first shelf from the horizontal position to the vertical position.

14. A foldable storage compartment for storing objects on a shelf when the storage compartment is in an erect position, the foldable storage compartment comprising:

a first frame and a second frame;

a first shelf defining a first side edge and an opposed second side edge to the first side edge and a third front edge and an opposed fourth rear edge to the third front edge, the first shelf defining a horizontal axis by a direction from the first side edge to the opposed second side edge, the first shelf being pivotable about the horizontal axis, the first shelf being rigid in a direction from the first side edge to the opposed second side edge, the first shelf being pivotable adjacent the fourth rear edge and the fourth rear edge closer to the second frame than the first frame;

a collapsible first side strip disposed adjacent to the first side edge, the collapsible first side strip attached to the first frame and the second frame, the collapsible first side strip being rigid vertically and being collapsible about a first vertical axis;

a collapsible second side strip disposed adjacent to the second side edge, the collapsible second side strip attached to the first frame and the second frame, the collapsible second side strip being rigid vertically and being collapsible about a second vertical axis;

wherein the horizontal axis about which the first shelf is foldable is adjacent to the fourth rear edge of the first shelf and the foldable storage compartment further comprises a linkage pivotally attached to the first shelf between the third front edge and the opposed fourth rear edge and the first frame.

15. A method for collapsing and erecting a foldable storage compartment, the method comprising the steps of:

providing a foldable storage compartment, the foldable storage compartment comprising:

a first frame and a second frame;

a first shelf defining a first side edge and an opposed second side edge to the first side edge and a third front edge and an opposed fourth rear edge to the third front edge, the first shelf defining a horizontal axis by a direction from the first side edge to the opposed second side edge, the first shelf being pivotable about the horizontal axis, the first shelf being rigid in a direction from the first side edge to the opposed second side edge, the first shelf being pivotable adjacent the fourth rear edge and the fourth rear edge being closer to the second frame than the first frame;

a collapsible first side strip disposed adjacent to the first side edge, the collapsible first side strip attached to the first frame and the second frame, the collapsible first side frame being rigid vertically and being collapsible about a first vertical axis;

a collapsible second side strip disposed adjacent to the second side edge, the collapsible second side strip attached to the first frame and the second frame, the collapsible second side strip being rigid vertically and being collapsible about a second vertical axis;

wherein the horizontal axis about which the first shelf is foldable is adjacent to the fourth rear edge of the first shelf and the foldable storage compartment further comprises a linkage pivotally attached to the first shelf between the third front edge and the opposed fourth rear edge and the first frame;

pulling the front and second frames further away from each other when the foldable storage compartment is in a collapsed position traverses the foldable storage compartment to an erect position and the first shelf from a vertical position to a horizontal position; and lifting the first shelf upwards traverses the front and second frames closer to each other and the first shelf from the horizontal position to the vertical position.

* * * * *